US011913247B1

(12) United States Patent
Hollberg et al.

(10) Patent No.: US 11,913,247 B1
(45) Date of Patent: Feb. 27, 2024

(54) MOBILE PERIMETER SECURITY SYSTEM

(71) Applicant: Zap Panel LLC, Salt Lake City, UT (US)

(72) Inventors: John Thomas Hollberg, Salt Lake City, UT (US); Alissa Wood Hollberg, Salt Lake City, UT (US); Brigham Andrew Wilcox, Holladay, UT (US); Emit Benjamin Meyer, Salt Lake City, UT (US)

(73) Assignee: ZAP PANEL LLC, Salt Lake City, UT (US)

( * ) Notice: Subject to any disclaimer, the term of this patent is extended or adjusted under 35 U.S.C. 154(b) by 0 days.

(21) Appl. No.: 18/144,337

(22) Filed: May 8, 2023

Related U.S. Application Data

(60) Provisional application No. 63/411,906, filed on Sep. 30, 2022.

(51) Int. Cl.
*E04H 17/02* (2006.01)
*E04H 17/00* (2006.01)

(52) U.S. Cl.
CPC ..... *E04H 17/017* (2021.01); *E04H 17/02* (2013.01)

(58) Field of Classification Search
CPC ..... E04H 17/017; E04H 17/163; E04H 17/17; E04H 17/18; E04H 17/185; E04H 17/00; E04H 17/131; E04H 17/009; A01K 3/005; Y10T 403/4608; Y10T 403/4611; Y10T 403/4617; Y10T 403/4621; Y10T 403/7129; Y10T 403/7164; Y10T 403/7182
See application file for complete search history.

(56) References Cited

U.S. PATENT DOCUMENTS 4,711,595 A * 12/1987 Magid ..... B25B 27/14 403/205
4,730,809 A * 3/1988 Stoler ..... E04H 17/127 200/61.93
5,402,988 A * 4/1995 Eisele ..... A63B 71/022 256/73
6,264,172 B1 * 7/2001 Ball ..... A01K 1/03 256/25
6,343,778 B1 * 2/2002 Brown ..... E01F 15/0415 256/10

(Continued)

FOREIGN PATENT DOCUMENTS

CN 112189576 A 1/2021
CN 114753665 A * 7/2022

(Continued)

*Primary Examiner* — Joshua T Kennedy
(74) *Attorney, Agent, or Firm* — Workman Nydegger

(57) ABSTRACT

A modular, electrically chargeable protective barrier that is structured to be coupled to a temporary fence panel is disclosed. The barrier includes a frame comprising multiple side vertical conductive support members and multiple horizontal conductive support members. The frame is electrically chargeable. The barrier includes multiple exposed conductive wires spanning a distance between the side vertical conductive support members. The exposed conductive wires are electrically chargeable, and a charge passes from the wires to the frame. The barrier includes a conductive bracket and a non-conductive bracket.

20 Claims, 25 Drawing Sheets

(56) References Cited

U.S. PATENT DOCUMENTS

| | | | | |
|---|---|---|---|---|
| 6,779,941 | B2 * | 8/2004 | Tinn | F16B 7/0493 403/192 |
| 8,628,065 | B2 | 1/2014 | Reid | |
| 10,070,508 | B2 | 9/2018 | Ricks et al. | |
| 10,787,835 | B2 * | 9/2020 | Kalish | E04H 15/006 |
| 2008/0006808 | A1 * | 1/2008 | Thompson | E04H 17/163 256/45 |
| 2017/0019980 | A1 * | 1/2017 | Ricks | H05C 1/00 |
| 2019/0029220 | A1 * | 1/2019 | Ricks | E04H 17/05 |

FOREIGN PATENT DOCUMENTS

| | | | |
|---|---|---|---|
| DE | 102008048621 | A1 | 10/2009 |
| FR | 2592512 | A1 | 7/1987 |

* cited by examiner

600

MOBILE PERIMETER SECURITY SYSTEM

CROSS-REFERENCE TO RELATED APPLICATIONS

This application claims the benefit of and priority to U.S. Provisional Patent Application Ser. No. 63/411,906 filed on Sep. 30, 2022 and entitled "MODULAR ELECTRIC SECURITY BARRIER," which application is expressly incorporated herein by reference in its entirety.

BACKGROUND

Fences are often used to protect valuable assets or to prevent or deter actors (e.g., humans, animals, etc.) from entering a potentially hazardous area. Although an actor can potentially climb over the fence, the presence of the fence often operates as a deterrent or at least as a warning to the actor.

Generally, fences can be permanent or temporary. A permanent fence often uses posts buried in the ground and secured in place using concrete. A permanent fence provides a long-term stationary enclosure for a given area. A temporary fence, on the other hand, can be easily erected, subsequently removed, and later transported to another location. Temporary fences are often used for construction sites or for other temporary locations needing protection. Some laws may even require the use of a fence for a given area, such as perhaps a work zone.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

In some aspects, the techniques described herein relate to a mobile perimeter security system including: a frame including a first side vertical conductive support member, a second side vertical conductive support member, a middle vertical conductive support member, an upper horizontal conductive support member, a lower horizontal conductive support member, a middle horizontal conductive support member, wherein the frame is electrically chargeable; a plurality of exposed conductive wires spanning a distance between the first side vertical conductive support member and the second side vertical conductive support member, wherein the plurality of exposed conductive wires are electrically chargeable; a conductive bracket, wherein the conductive bracket is structured to facilitate coupling the frame of the mobile security system to a different frame of a different mobile security system, and wherein the conductive bracket is electrically chargeable; and a non-conductive bracket, wherein the non-conductive bracket is structured to facilitate coupling the frame to a temporary fence panel, and wherein the non-conductive bracket is insulated from being electrically chargeable.

In some aspects, the techniques described herein relate to a modular, electrically chargeable protective barrier that is structured to be coupled to a temporary fence panel, said modular, electrically chargeable protective barrier including: a frame including a first side vertical conductive support member, a second side vertical conductive support member, a middle vertical conductive support member, an upper horizontal conductive support member, and a lower horizontal conductive support member, wherein the frame is electrically chargeable; a plurality of exposed conductive wires spanning a distance between the first side vertical conductive support member and the second side vertical conductive support member, wherein the plurality of exposed conductive wires are electrically chargeable, and wherein a charge passes from the plurality of exposed conductive wires to the frame; a conductive bracket disposed on either one of the first side vertical conductive support member or the second side vertical conductive support member, wherein the conductive bracket is structured to facilitate coupling the frame of the modular, electrically chargeable protective barrier to a different frame of a different modular, electrically chargeable protective barrier, wherein the conductive bracket is electrically chargeable, and wherein the charge passes from the frame to the conductive bracket; and a non-conductive bracket disposed on either one of the first side vertical conductive support member or the second side vertical conductive support member, wherein the non-conductive bracket is structured to facilitate coupling the frame to the temporary fence panel, and wherein the non-conductive bracket is insulated such that the charge is prevented from passing through the non-conductive bracket.

In some aspects, the techniques described herein relate to a modular, electrically chargeable protective barrier that is structured to be coupled to a temporary fence panel, said modular, electrically chargeable protective barrier including: a frame including a first side vertical conductive support member, a second side vertical conductive support member, a middle vertical conductive support member, an upper horizontal conductive support member, and a lower horizontal conductive support member, wherein the frame is electrically chargeable; a plurality of exposed conductive wires spanning a distance between the first side vertical conductive support member and the second side vertical conductive support member, wherein the plurality of exposed conductive wires are electrically chargeable, and wherein a charge passes from the plurality of exposed conductive wires to the frame; a set of conductive brackets disposed on the frame, wherein the set of conductive brackets are structured to facilitate coupling the frame to a different frame of a different modular, electrically chargeable protective barrier, wherein the set of conductive brackets are electrically chargeable; and a set of non-conductive brackets disposed on the frame, wherein the set of non-conductive brackets are structured to facilitate coupling the frame to the temporary fence panel, and wherein the set of non-conductive brackets are insulated.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

The disclosed embodiments are directed to a type of lightweight, portable, and modular fence attachment that can be coupled to a temporary fence panel or perhaps even a permanent fence panel. This attachment is referred to herein as a "mobile perimeter security system" (MPSS) or a "modular, electrically chargeable protective barrier." The MPSS and the fence panel combination provide a heightened level of protection for a given area.

The MPSS is electrically charged and will electrically shock an actor (e.g., human, animal, etc.) who may contact the MPSS. Beneficially, the frame of the MPSS as well as the wires spanning the MPSS are electrically charged. By electrifying not only the wires but also the frame, the embodiments further increase the deterrence factor provided by the MPSS.

The MPSS includes a base support that is not electrically charged, so the MPSS can contact the ground for additional support. The base can be modified in height to accommodate non-level ground areas.

The MPSS also beneficially includes brackets of differing types. One type is a conductive bracket used to couple one MPSS to another MPSS. The electric charge can flow from one MPSS through the conductive bracket to a second MPSS. The other type of bracket is a non-conductive bracket used to couple the MPSS to a fence panel.

Beneficially, the MPSS is highly portable and lightweight. Typically, the MPSS weighs less than about 75 pounds. Often, the weight is between about 50 pounds and 60 pounds. The MPSS can be erected by a single technician in a quick and easy manner. Removal of the MPSS can also be achieved by a single technician. The MPSS can be easily stacked in a horizontal manner, such as on a trailer bed. A stack of MPSSs can then be easily shipped or transported to a new location.

An MPSS can be prefabricated and delivered to any site. In some instances, an MPSS can be fabricated on-site. Fabrication of an MPSS can be performed relatively quickly.

An MPSS can be coupled to any type of fence panel, or rather, any brand of fence panel. In this sense, an MPSS is agnostic with respect to brand or type of fence panel. Although a majority of this disclosure is focused on coupling an MPSS to a temporary fence panel, a skilled person will recognize how the MPSS can be coupled to a permanent fence panel as well. Accordingly, the disclosed embodiments provide various improvements to the technical field of fencing. Such improvements include, but are not limited to, a highly portable, lightweight, and modular attachment that is capable of being electrically charged to deter actors from entering a restricted area. These and numerous other benefits will now be discussed in more detail throughout the remaining sections of this document.

Temporary Fence Panel

Figure 1:
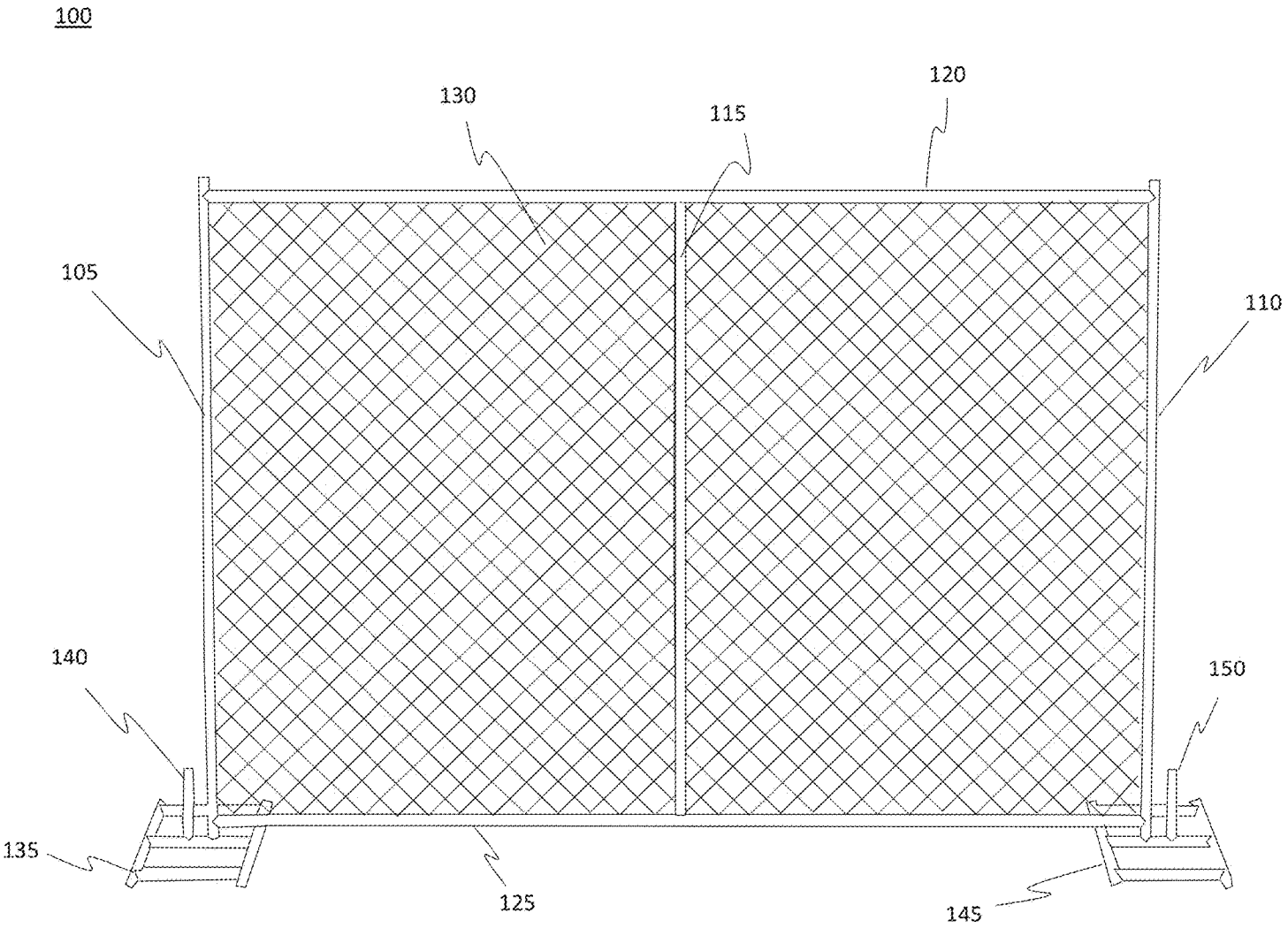
FIG. 1 illustrates an example of a temporary fence panel.

Attention will now be directed to FIG. 1, which illustrates an example of a temporary fence panel 100. The temporary fence panel 100 is a type of lightweight, portable structure designed to control access to a given area by impeding an actor's ability to pass through the fence.

Panel 100 is shown as including a first side vertical support member 105 and a second side vertical support member 110. Panel 100 further includes a middle vertical support member 115 positioned in between the member 105 and the member 110. Panel 100 also includes an upper horizontal support member 120 and a lower horizontal support member 125.

The terms "vertical" and "horizontal" should be interpreted as being generally orthogonal to one another and should not be viewed as being strictly vertical or horizontal with respect to a gravity vector. Instead, a "vertical" support member is generally orthogonal to a "horizontal" support member. Stated differently, a support member can be vertical even if it is not positioned exactly parallel relative to the gravity vector. Similarly, a support member can be horizontal even if it is not exactly perpendicular relative to the gravity vector. It should also be noted how flexibility in the support structures is permissible such that a vertical support member may not necessarily be perpendicular relative to a horizontal support member. Thus, the terms "vertical" and "horizontal," as used herein, should be interpreted as allowing a level of angular offset (e.g., between about 0-10 degrees) with respect to one another.

Together, the members 105, 110, 115, 120, and 125 provide a frame to support a chain link 130. Chain link 130 operates to prevent actors and/or other objects from easily passing through the panel 100.

Panel 100 further includes a base 135, which includes a protruding member 140, and a base 145, which includes a protruding member 150. The members 140 and 150 are provided to allow another panel's vertical support member to be coupled to the base 135/145, thereby linking one panel to another. Although not labeled, the members 105/110 are similarly coupled to protruding members of the bases 135/145.

Not all temporary fence panels include the bases 135/145. In some cases, a temporary fence panel may include vertical support members that are embedded some distance into the ground. Despite being embedded in the ground, these panels should still be considered "temporary" if the support panels can be removed from the ground via non-destructive processes or without the use of heavy machinery.

Figure 2:
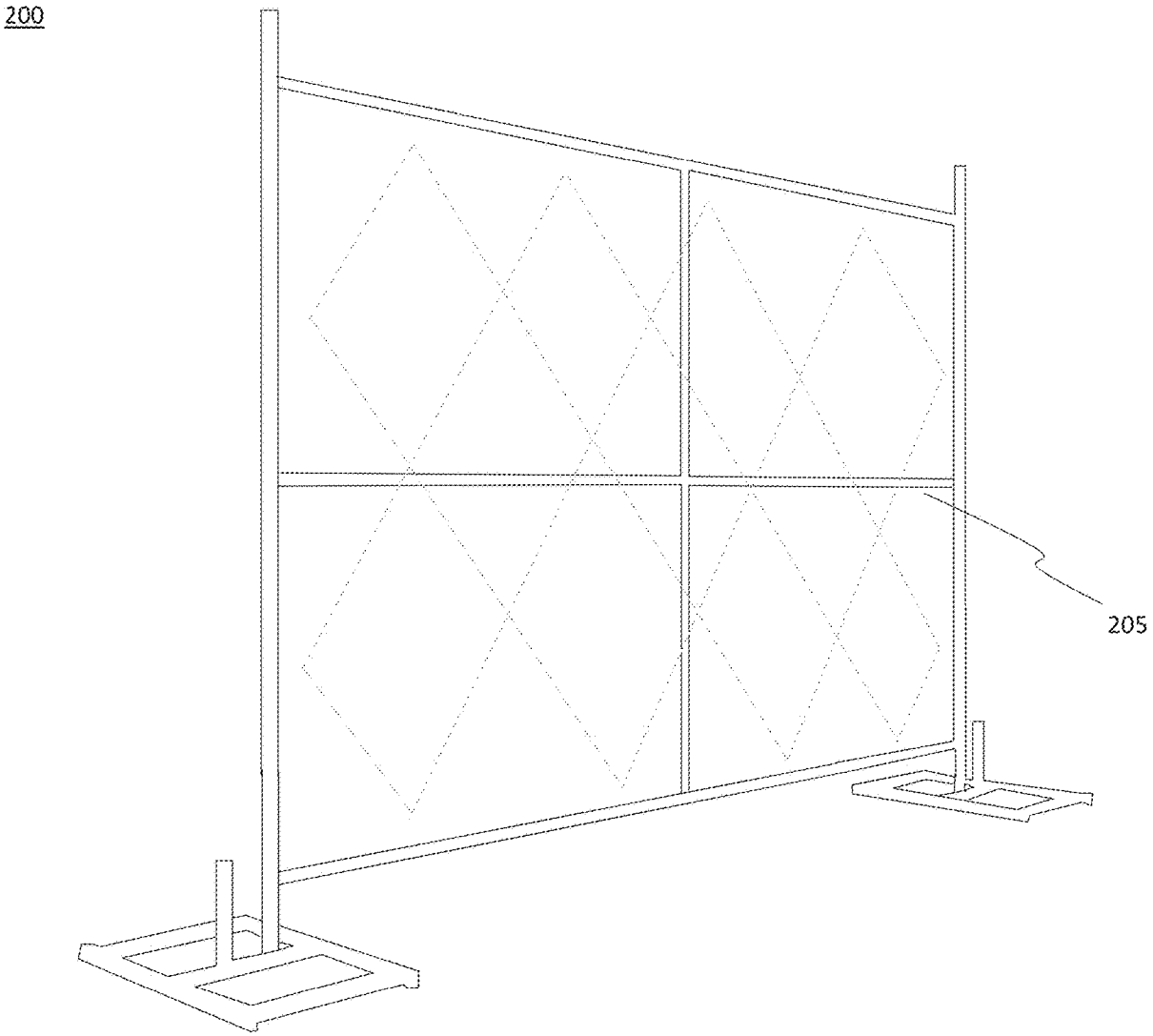
FIG. 2 illustrates another example of a temporary fence panel.

FIG. 2 shows another temporary fence panel 200 that is similar to panel 100 of FIG. 1. One difference between the two illustrations is that the panel 200 further includes a middle horizontal support member 205, which, together with the middle vertical support member, provides a cross-like structure that provides additional support for the fence panel.

Figure 3:
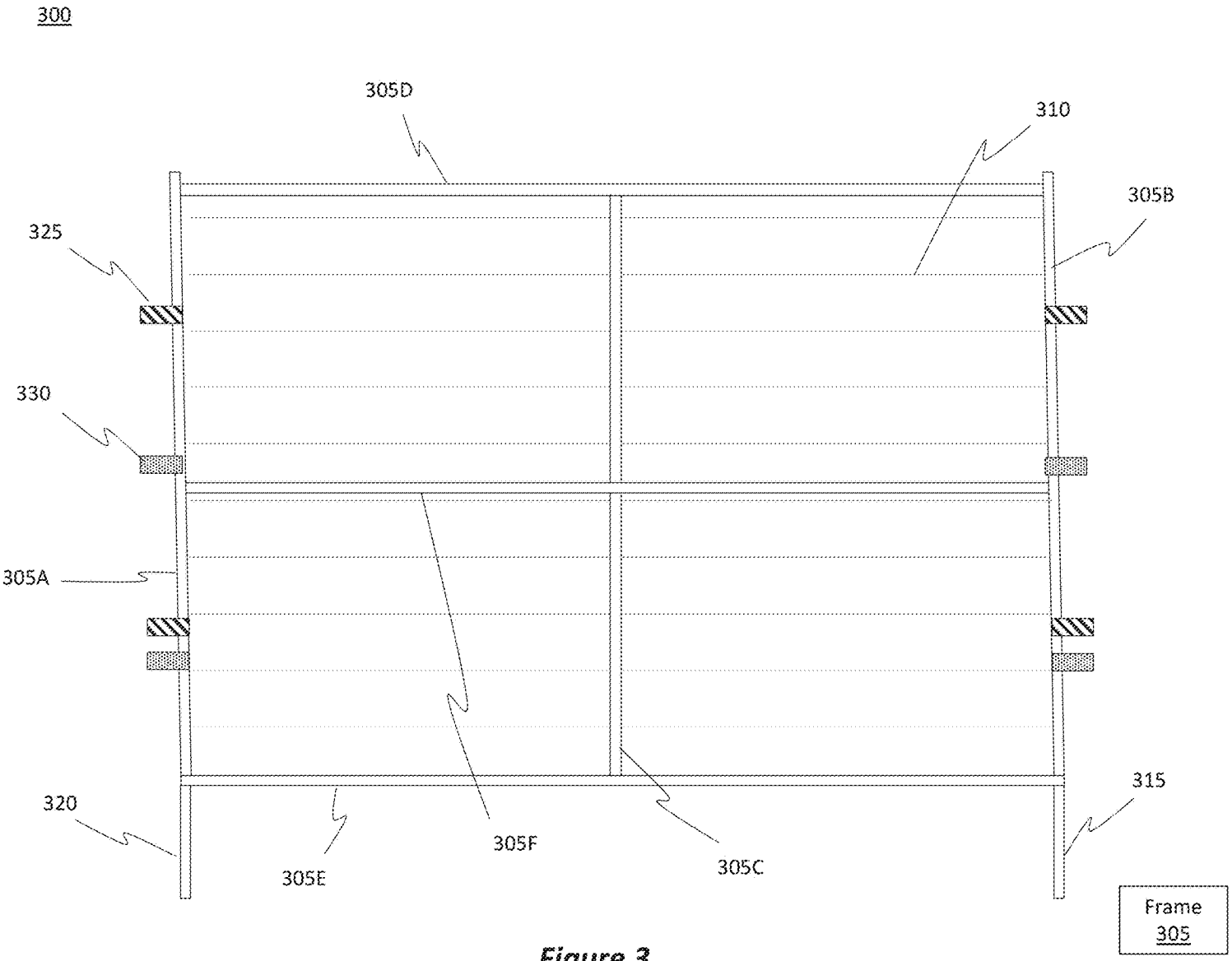
FIG. 3 illustrates an example of a mobile perimeter security system (MPSS), which is also called a modular, electrically chargeable protective barrier.

Mobile Perimeter Security System/Modular, Electrically Chargeable Protective Barrier Attention will now be directed to FIG. 3, which illustrates a mobile perimeter security system (MPSS) 300, which is also called a modular, electrically chargeable protective barrier. In accordance with the disclosed principles, the MPSS 300 can be affixed to any type of temporary or permanent fence panel. The MPSS 300 provides a heightened level of security and protection over a scenario in which a fence panel is used by itself. In particular, the MPSS 300 is a unit that can be electrically charged such that the MPSS 300 operates as an electric fence. Beneficially, due to the structure of the MPSS 300, only the MPSS 300 is electrically charged while the fence panel will not be electrically charged even though the MPSS 300 contacts the fence panel and is securely coupled thereto.

If a set of fence panels are arranged so as to protect an asset or surround some material, it is typically the case that the MPSS 300 is disposed on the inside of the surrounding fence panels, or rather on the side facing the assets. Thus, if an actor were to externally approach the fence, the assets and the MPSS 300 are on the opposite side of the fence relative to the actor. As a result, the fence panel is closer to the approaching actor as compared to the MPSS 300. The fence panel provides a first level of protection for the asset while the MPSS 300 provides a second, heightened level of protection for the asset. In some cases, a warning sign can be affixed to either one or both of the fence panel or the MPSS 300 to warn an approaching actor about the electrically shocking capability of the MPSS 300.

The MPSS 300 can be energized using any type of power source, including mobile power sources and immobile power sources. Examples of such power sources include, but are not limited to, any type of solar power source, grid power source, renewable power source, non-renewable power source, and so on.

Generally, the power source provides anywhere from 2,000 volts to 8,000 volts to the MPSS 300. Typically, the power source provides between about 2,000 volts and 4,000 volts. In some cases, the voltage levels can vary, depending on climate, region, or season. In any event, regardless of what type of power source is used, the power source is electrically coupled to the MPSS 300 and provides an electric charge to the MPSS 300. If an actor tries to climb the fence panel and then comes into contact with the MPSS 300, that actor will be electrically shocked and will thus be highly dissuaded or deterred from continuing to advance forward.

MPSS 300 is shown as including a frame 305. Frame 305 includes a first side vertical conductive support member 305A, a second side vertical conductive support member 305B, a middle vertical conductive support member 305C, an upper horizontal conductive support member 305D, a lower horizontal conductive support member 305E, and a middle horizontal conductive support member 305F. These support members 305A-305F are made of conductive material such that the frame is electrically chargeable.

As an example, the support members 305A-305F can be made from galvanized steel, aluminum, copper, brass, or any other type of conductive material that can also operate as a support frame for the MPSS 300. Preferably, the support members 305A-305F are made of lightweight galvanized steel. The members 305C and 305F form a cross-like structure that provides further support for the outer members 305A, 305B, 305D, and 305E.

Spanning horizontally between the members 305A and 305B are a plurality of exposed conductive wires, one of which is labeled as exposed conductive wire 310. Stated differently, the MPSS 300 includes a plurality of exposed conductive wires spanning a distance between a first side vertical conductive support member (e.g., member 305A) and a second side vertical conductive support member (e.g., member 305B). These wires are electrically chargeable via the power source. If an actor contacts one or more of these wires, that actor will be electrically shocked.

Although the illustrations show the wires as spanning the frame in a horizontal manner, different spanning techniques can also be used. For instance, the wires can span vertically, horizontally, diagonally, or any combination thereof. In some cases, a wire mesh can be used instead of or in addition to individual wires. Accordingly, the wires span the distance between the support members in one or more of a horizontal configuration, a vertical configuration, and/or a diagonal configuration.

The members 305A-305F are also conductive and thus also can carry the charge. Because the exposed conductive wires contact the members 305A-305F, the charge passes through the members 305A-305F. Thus, if an actor contacts any of the members 305A-305F, that actor will also be electrically shocked, even if the actor does not contact any of the exposed conductive wires. As a result, frame 305 as well as the wires are electrically chargeable, resulting in an increased deterrent factor provided by the MPSS 300.

MPSS 300 further includes a base member 315 and a base member 320. As will be discussed in more detail later, the base members 315/320 are not electrically chargeable or rather, they are insulated from being electrically chargeable. The base members 315/320 (*i*) are adjustable, (ii) operate as a support for the MPSS 300, and (iii) contact the ground.

MPSS 300 also includes at least one bracket of a first type and at least one bracket of a second, different type. To illustrate, the bracket of the first type is labeled as conductive bracket 325, which is shown as having a diagonal cross pattern. In FIG. 3, MPSS 300 is shown as including four of these types of brackets. Preferably, four conductive brackets are used. In some implementations, 1, 2, 3, 4, 5, 6, 7, 8, 9, 10, or more than 10 conductive brackets are used.

The conductive brackets are formed of conductive material, such as any of the conductive materials mentioned above. These conductive brackets are structured to connect a first MPSS to a second MPSS. Charge can thus flow from the first MPSS through the conductive bracket to the second MPSS. The conductive brackets are disposed on the MPSS 300 on the side vertical conductive support members (e.g., members 305A or 305B). The middle vertical conductive support member 305C omits a conductive bracket. Further details on this conductive bracket will be provided later.

The bracket of the second type is labeled as non-conductive bracket 330, which is shown as having a dotted pattern. In FIG. 3, MPSS 300 is shown as including four of these types of brackets. Preferably, four non-conductive brackets are used. In some implementations, 1, 2, 3, 4, 5, 6, 7, 8, 9, 10, or more than 10 non-conductive brackets are used.

The non-conductive brackets include or are formed of insulating material that prevents a charge from passing through it. These non-conductive brackets are structured to connect the MPSS 300 to a temporary fence panel, such as panel 100 of FIG. 1 or panel 200 of FIG. 2. The non-conductive brackets are disposed on the MPSS 300 on the side vertical conductive support members (e.g., members 305A or 305B). Optionally, the middle vertical conductive support member 305C may also include one or more non-conductive brackets, depending on whether the fence panel includes a middle vertical support member. Further details on this non-conductive bracket will be provided later.

Figure 4:
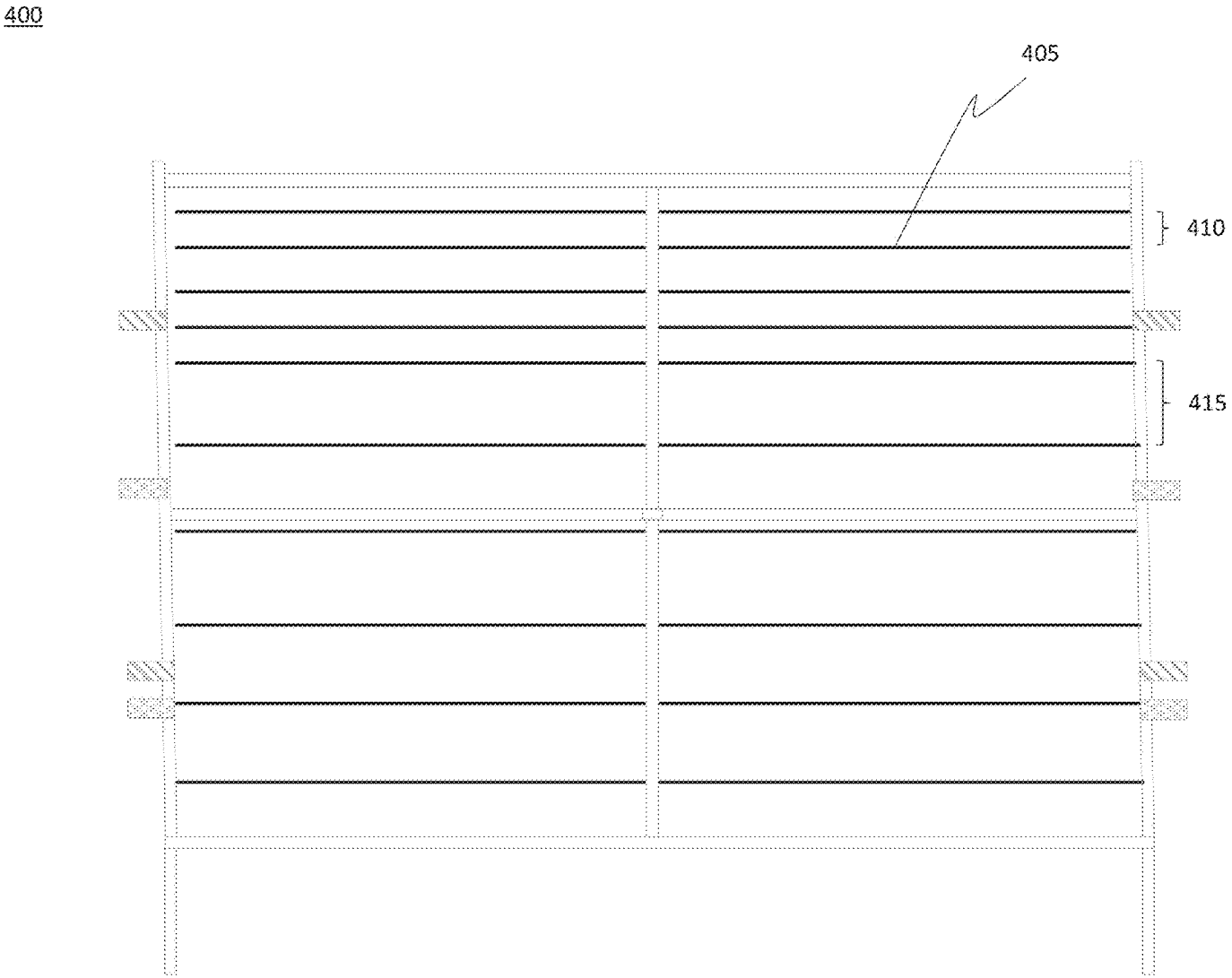
FIG. 4 illustrates another example of the MPSS.

FIG. 4 shows a modular, electrically chargeable protective barrier 400, which is also referred to herein as an MPSS. This barrier 400 includes multiple exposed conductive wires, such as exposed conductive wire 405. In FIG. 3, the various different wires were shown as being evenly spaced apart relative to one another whereas in FIG. 4, the various different wires are shown as having different spacing. For instance, the spacing 410 is different than the spacing 415.

In some embodiments, the upper wires may be spaced closer together nearer the top of the barrier while the lower wires may be spaced farther apart nearer the bottom of the barrier. In some embodiments, the top half of wires may have one spacing while the bottom half of wires may have a different spacing. In some cases, the spacing may be different throughout the entire barrier. In some cases, a progressive spacing scheme may be used, where the largest spacing is near the bottom, and the spacing progressively gets smaller nearer the top.

In some instances, smaller spacing near the top of the barrier may operate as a greater hinderance to potential actors who may try to cross the barrier. For instance, it is typically the case that the barrier is taller than the temporary fence panel. Thus, even if the actor crawls on top of the fence, because the spacing of the wires is smaller on the MPSS, the actor will be unable to crawl through the gaps; further, the actor will be shocked if an attempt is made. The spacing can be larger near the bottom because the fence operates as an initial hinderance. That is, the actor would have to cut the fence before reaching the wires of the MPSS.

Base Member

Figure 5:
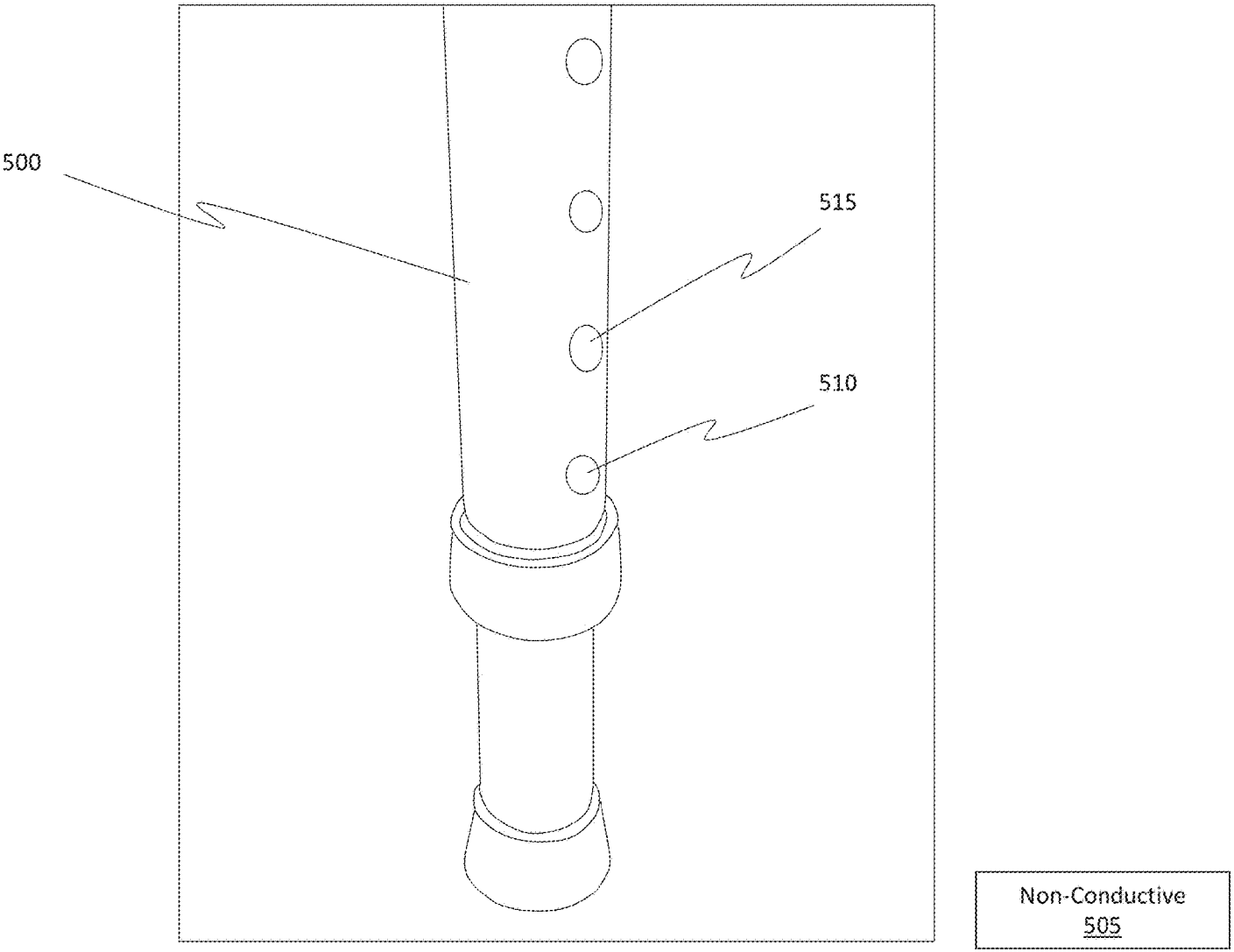
FIG. 5 illustrates an example of a base of the MPSS.

FIG. 5 shows a base member 500 that is representative of any of the bases 135/145 of FIG. 1. Notably, the base member 500 is insulated or is an insulator such that it is non-conductive 505. What this means is that the base member 500 will not be electrically charged even though it is attached to the frame of the MPSS. The base member 500 is typically configured so as to contact the ground and to operate as a ground support for the frame.

The base member 500, in some implementations, is adjustable in height. For instance, in some implementations, the base member 500 includes multiple height adjustment increments, such as height adjustment increments 510 and 515. The height of the base member 500 can be modified via use of these height adjustment increments. For example, base member 500 can include a retractable push pin that is insertable into any of the holes corresponding to the height adjustment increments, resulting in a telescopic feature for the MPSS. Of course, other height adjustment mechanisms can be used.

Further Details on the Support Members and Wires

Figure 6:
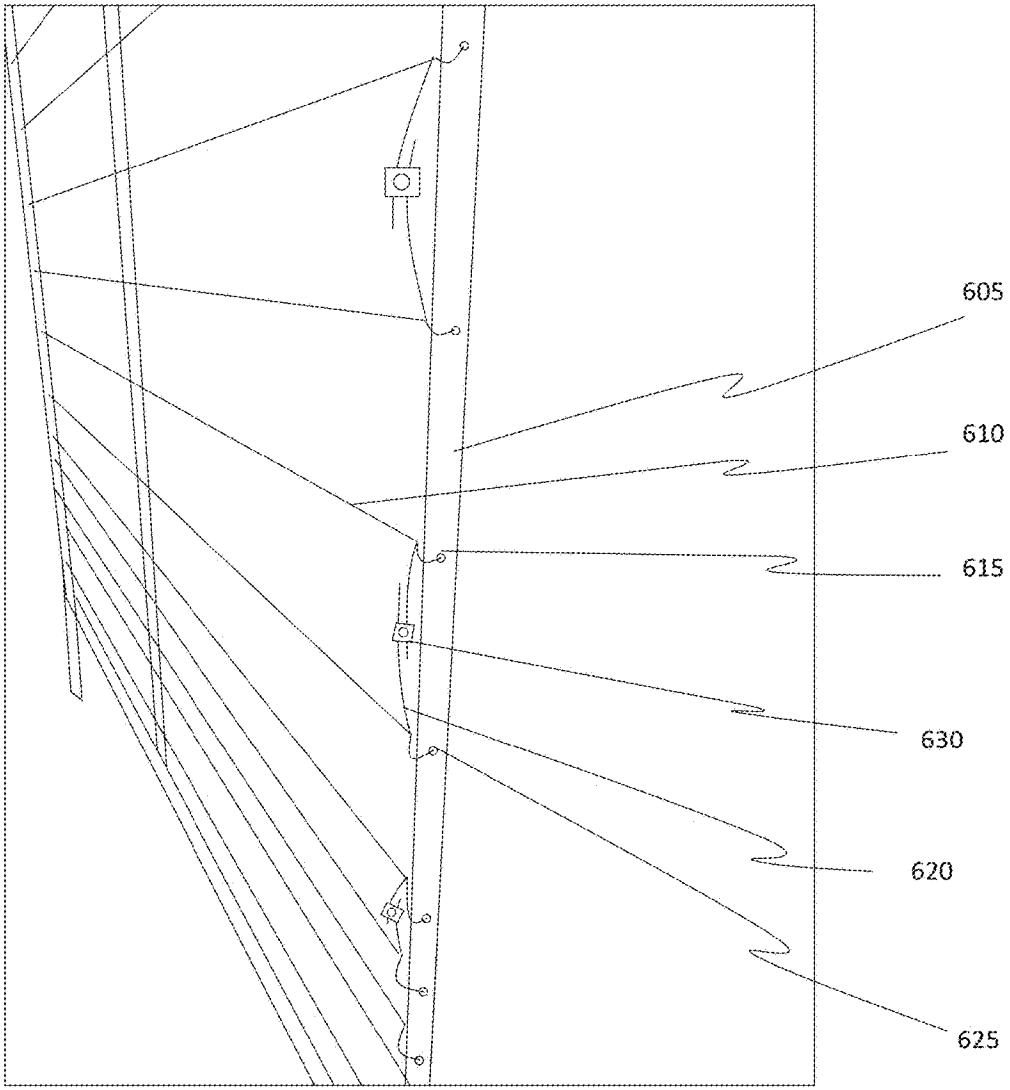
FIG. 6 illustrates various features of the MPSS.
Figure 7:
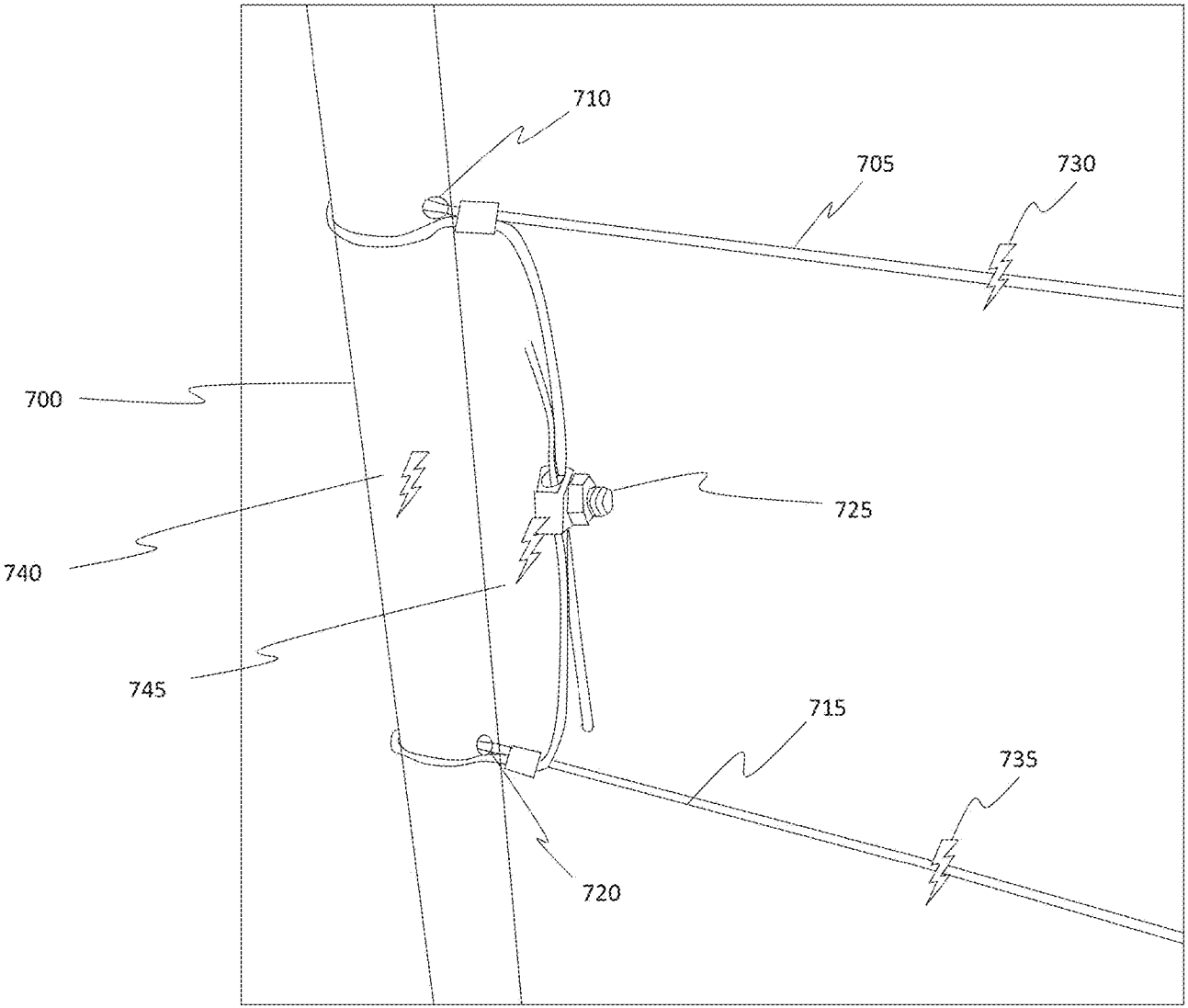
FIG. 7 illustrates various features of the MPSS.

FIG. 6 shows an MPSS 600 that includes a conductive support member 605, which is representative of any of the members 305A or 305B from FIG. 3. FIG. 6 also shows a conductive wire 610. Notice, the member 605 includes a hole 615 through which the conductive wire 610 passes or loops through. Similarly, another conductive wire 620 is shown as passing or looping through another hole 625 in member 605. Inasmuch as the conductive wire and the member 605 are conductive, the contact between the wires and the member 605 allows charge to freely flow through those two different components. In some embodiments, a further coupling can occur between the wires. For example, FIG. 6 shows a connection member 630 that couples the conductive wire 610 to the conductive wire 620. FIG. 7 provides additional details.

FIG. 7 shows a conductive support member 700, a wire 705 passing or looping through a hole 710 in the member 700, and a wire 715 passing or looping through another hole 720 in the member 700. A connection member 725 is shown as connecting the wire 705 to the wire 715. In some embodiments, the connection member 725 includes a coupling bracket with a nut and bolt, as depicted. Of course, other types of connections can be made.

Wire 705 is shown as being electrified 730. Similarly, wire 715 is shown as being electrified 735. Member 700 is also shown as being electrified 740. Also, even the connection member 725 is shown as being electrified 745. Thus, if an actor contacts the member 700, any of the wires, or even the connection member 725, that actor will be electrically shocked.

Figure 8:
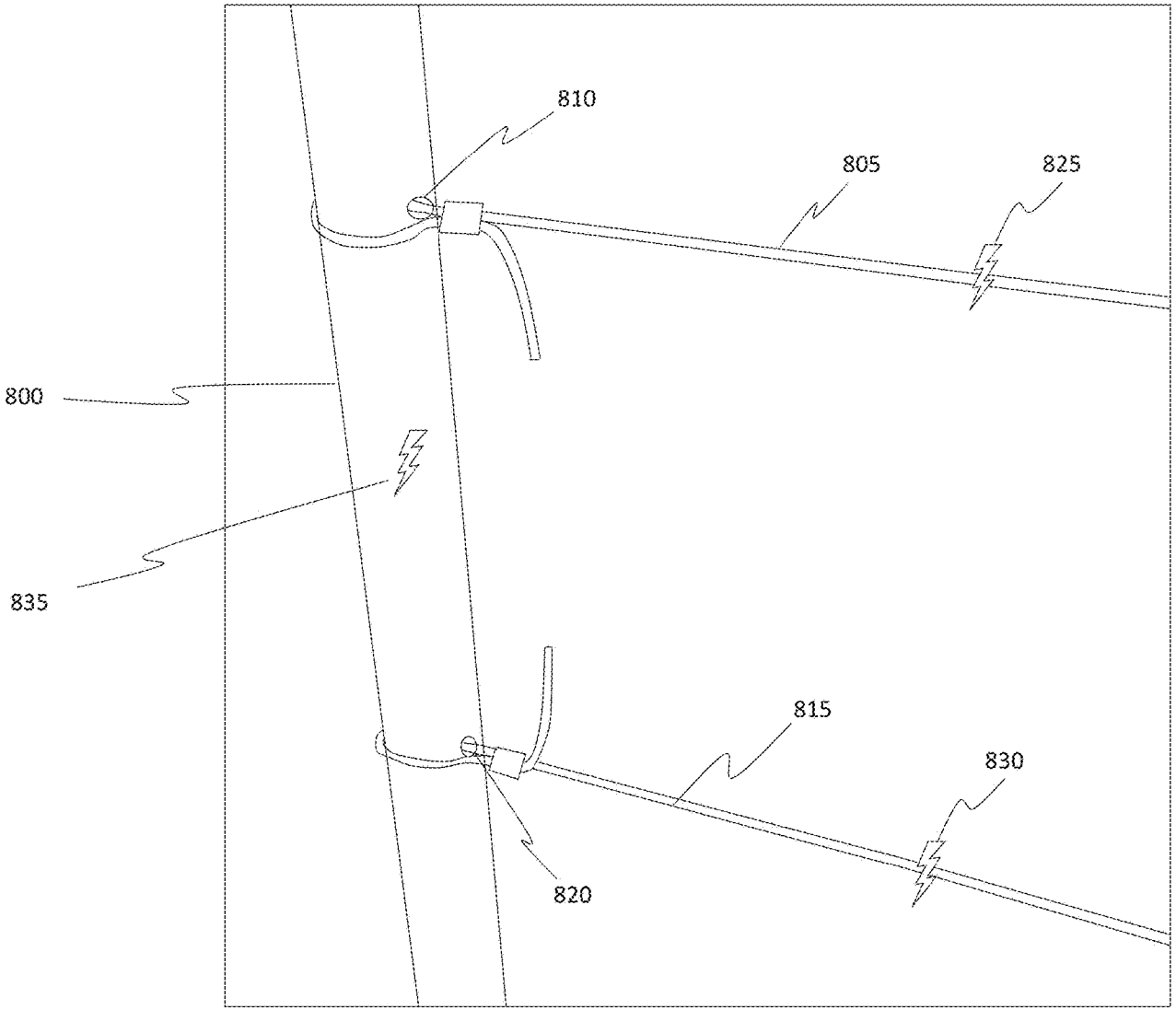
FIG. 8 illustrates various features of the MPSS.

FIG. 8 shows a scenario where the connection member 725 of FIG. 7 is omitted. That is, FIG. 8 shows a conductive support member 800, a wire 805 passing or looping through a hole 810 in the member 800, and a wire 815 passing or looping through another hole 820 in the member 800. Wire 805 is electrified 825, wire 815 is electrified 830, and member 800 is electrified 835. These components are all electrically coupled together via the contact by way of the holes 810/820 in which the wires are contacting the member 800. As a result of these contacts, electrical charge can pass through these various different components.

Figure 9:
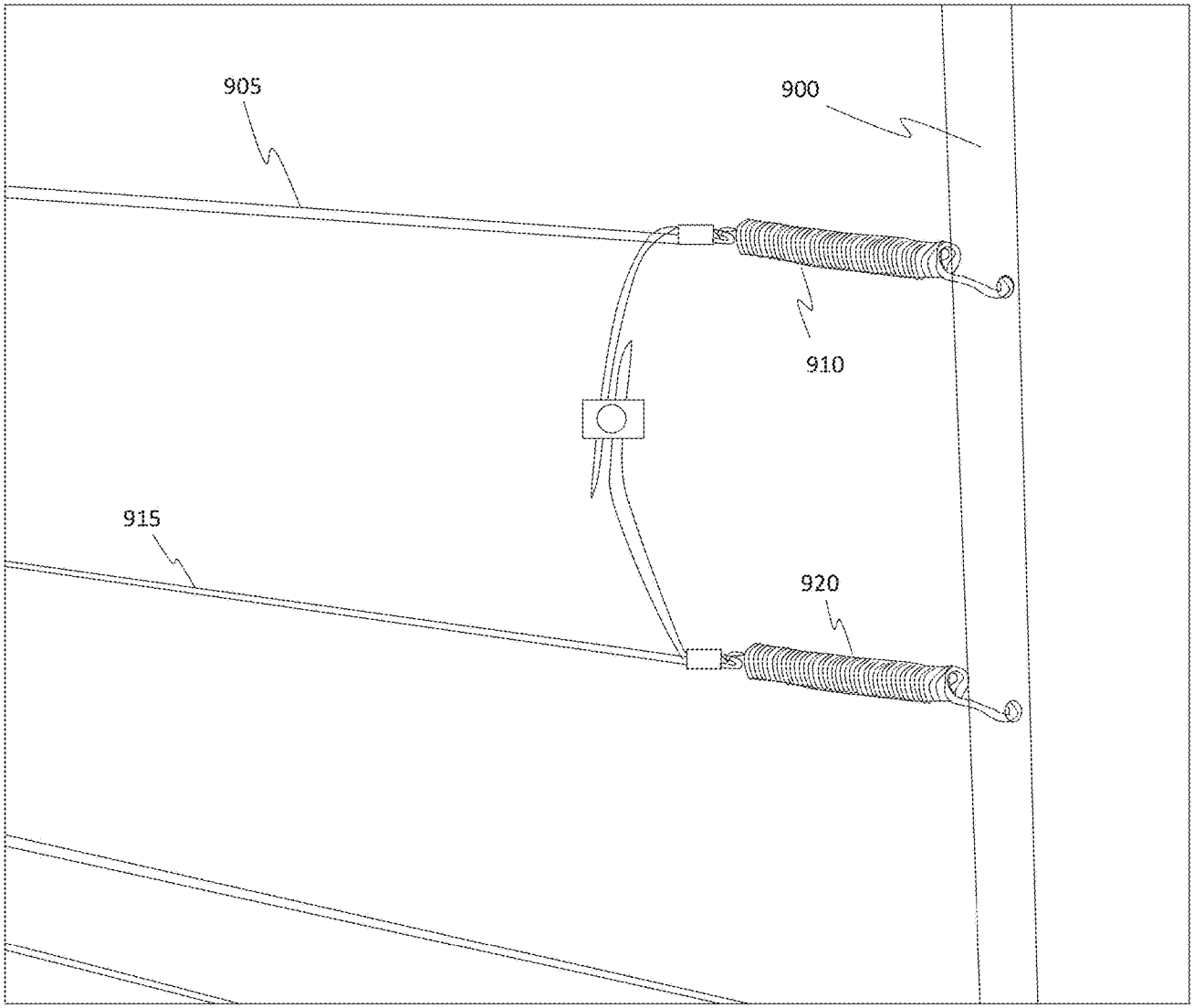
FIG. 9 illustrates various features of the MPSS.

FIG. 9 shows a conductive support member 900 and a wire 905. Wire 905 is coupled to a spring 910 that is also conductive and that can be made from any of the conductive materials mentioned earlier. Spring 910 includes a hook that hooks into a hole in member 900. Spring 910 provides a tension force on wire 905 to keep wire 905 taut. Similarly, wire 915 is coupled to a spring 920. Spring 920 includes a hook that hooks into a hole in member 900. Spring 920 provides a tension force on wire 915 to keep wire 915 taut.

Connection to a Temporary Fence Panel

Figure 10:
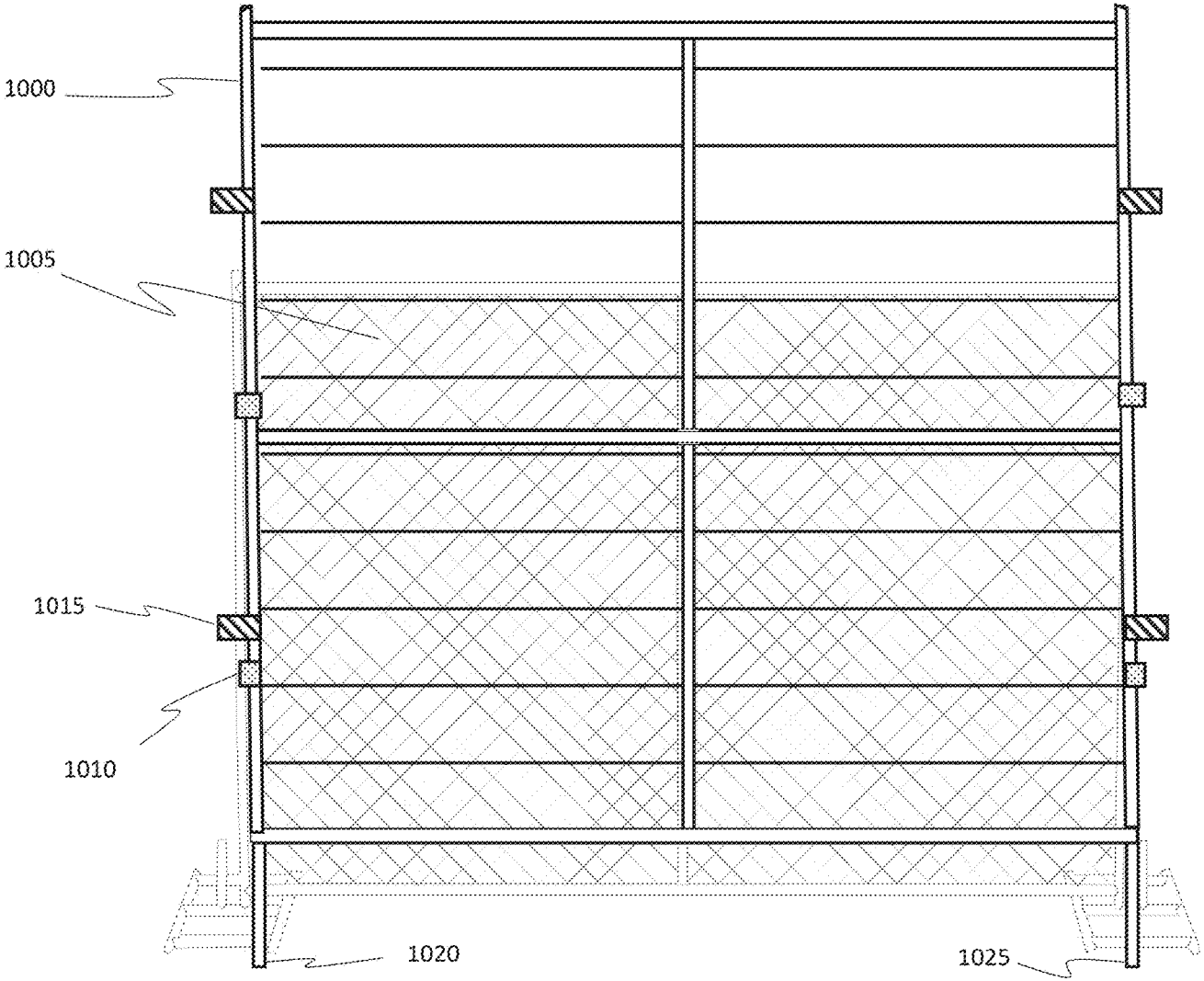
FIG. 10 illustrates how the MPSS can couple to a temporary fence panel.

FIG. 10 shows an MPSS 1000 that is coupled to a temporary fence panel 1005 by way of a non-conductive bracket 1010. MPSS 1000 can be coupled to another MPSS by way of a conductive bracket 1015. Thus, temporary fence panel 1005 is insulated from the charge carried by the MPSS 1000 by way of the non-conductive bracket 1010, but another MPSS can carry the charge by way of the conductive bracket 1015.

MPSS 1000 is further shown as including a base member 1020 and a base member 1025. These base members 1020/1025 operate as ground supports for the MPSS 1000. As mentioned before, the base members 1020/1025 are insulators or include insulation to prevent the charge from passing through the base members 1020/1025.

Figure 11:
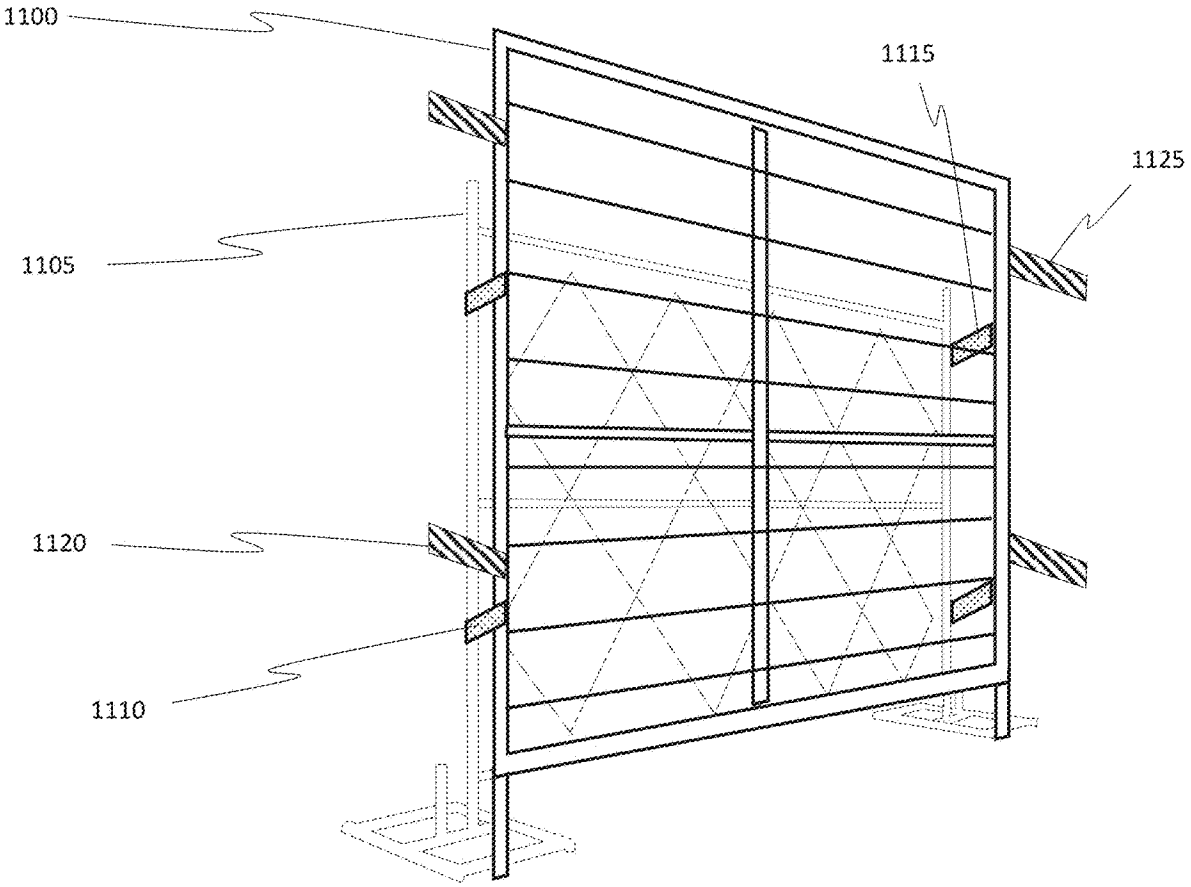
FIG. 11 illustrates how the MPSS can couple to a temporary fence panel.

FIG. 11 shows a side angled view of a MPSS 1100 that is coupled to a temporary fence panel 1105 via a number of non-conductive brackets, two of which are labeled as non-conductive brackets 1110 and 1115. In this example scenario, the MPSS 1100 includes four non-conductive brackets. FIG. 11 also shows a number of conductive brackets that can be used to couple the MPSS 1100 to another MPSS. To illustrate, FIG. 11 shows four conductive brackets, two of which are labeled as conductive brackets 1120 and 1125.

Figure 12:
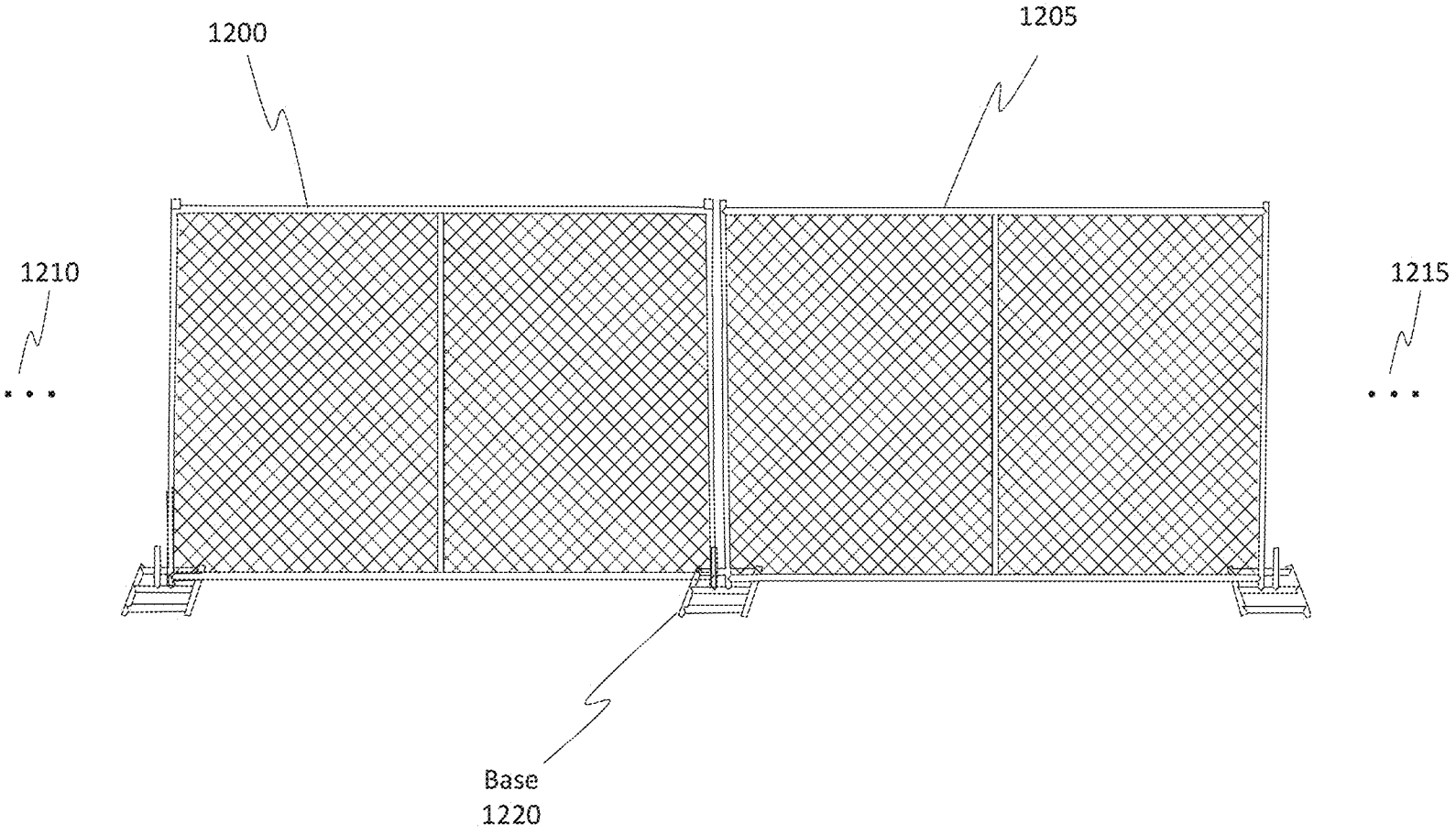
FIG. 12 illustrates multiple sections of a temporary fence panel.

FIG. 12 shows a series of temporary fence panels, such as temporary fence panels 1200 and 1205. The ellipses 1210 and 1215 demonstrate how any number of temporary fence panels can be coupled to one another. In this scenario, the temporary fence panels 1200 and 1205 are coupled together via use of the base 1220 and the protruding members of that base 1220. For example, those panels' support members are disposed in an enveloping manner over the protruding members.

Figure 13:
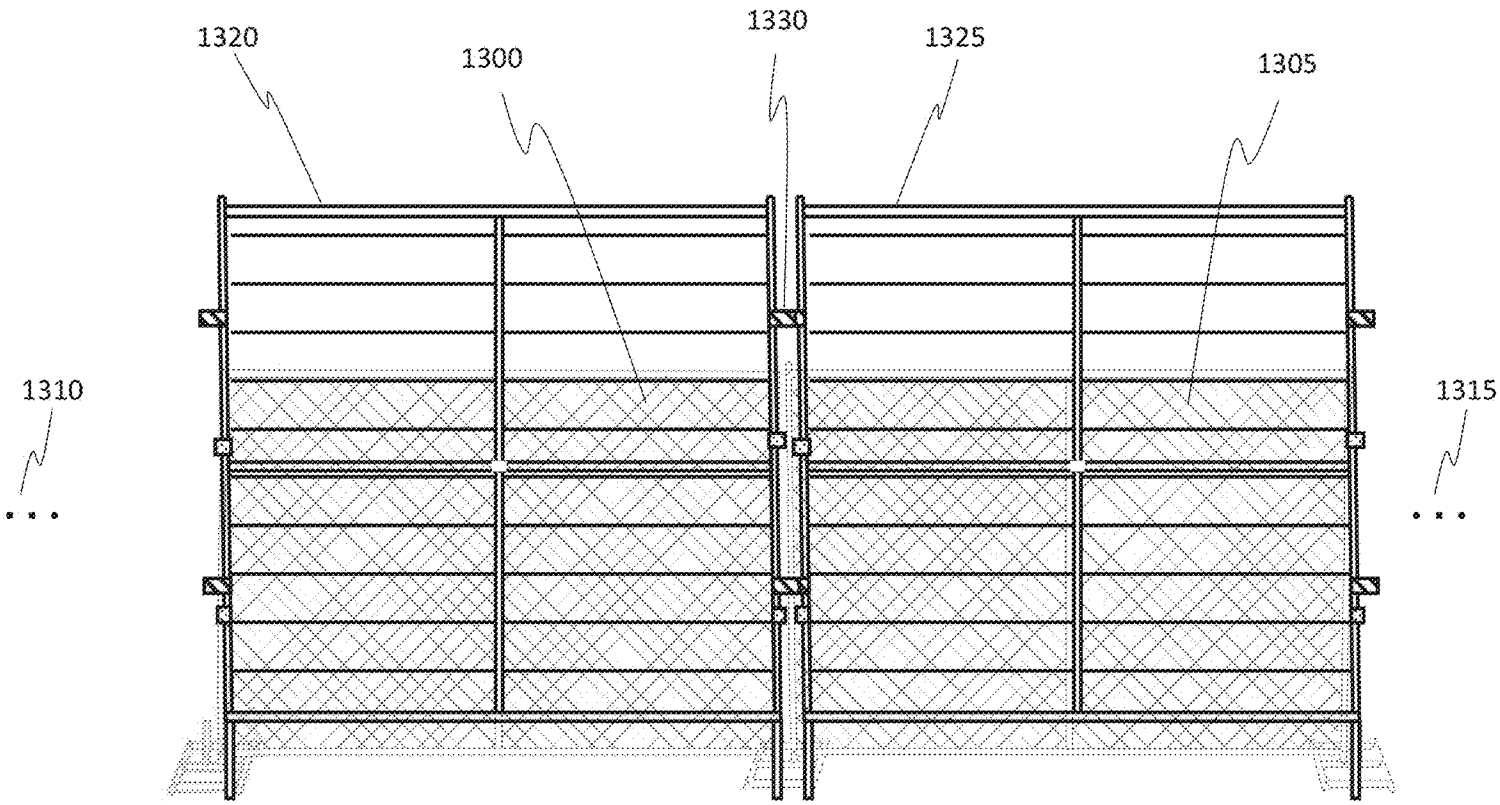
FIG. 13 illustrates how multiple MPSSs can couple to multiple temporary fence panels.

FIG. 13 shows a scenario in which multiple MPSS structures are coupled together. For example, FIG. 13 shows temporary fence panels 1300 and 1305. The ellipses 1310 and 1315 demonstrate how any number of panels may be used. A first MPSS 1320 is coupled to the panel 1300, and a second MPSS 1325 is coupled to the panel 1305. Various non-conductive brackets are used to couple the MPSSs to the panels. MPSS 1320 is coupled to MPSS 1325 via a conductive bracket 1330.

Conductive Brackets

Figure 14:
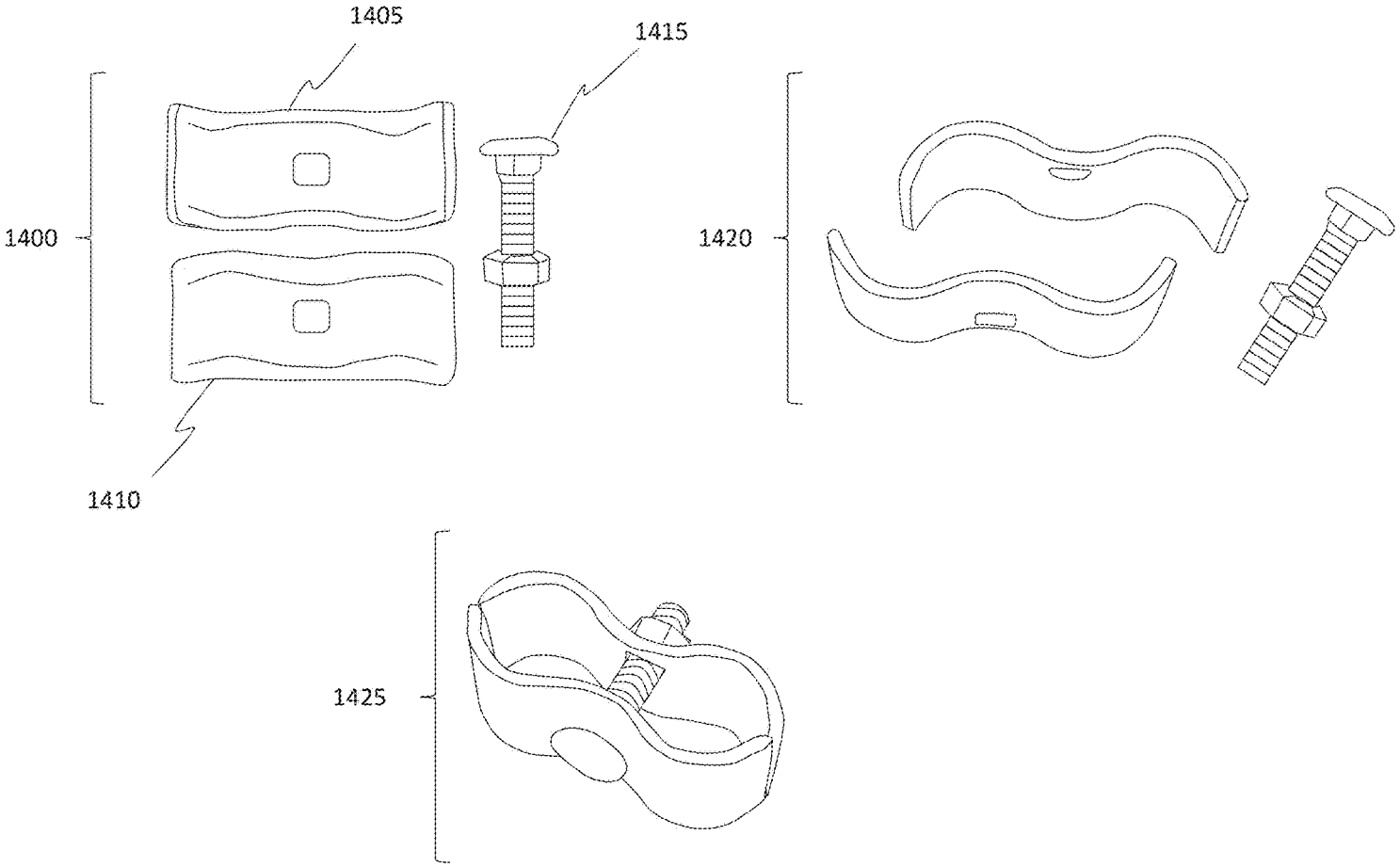
FIG. 14 illustrates different perspective views of a conductive bracket.

FIG. 14 shows a conductive bracket 1400 that is representative of any of the conductive brackets mentioned thus far. The conductive bracket 1400 is structured to couple a first MPSS to a second MPSS. The conductive bracket 1400 is made of any type of solid conductive material, such as any of the materials mentioned earlier.

Conductive bracket is shown as including a first component 1405, a second component 1410, and a coupler 1415. FIG. 14 shows a side angled view of the conductive bracket, as labeled by conductive bracket 1420. FIG. 14 further shows a scenario in which the components are coupled to one another, as labeled by conductive bracket 1425. A technician is able to readily assemble or install the conductive bracket on an MPSS in an intuitive and easy manner.

Figure 15:
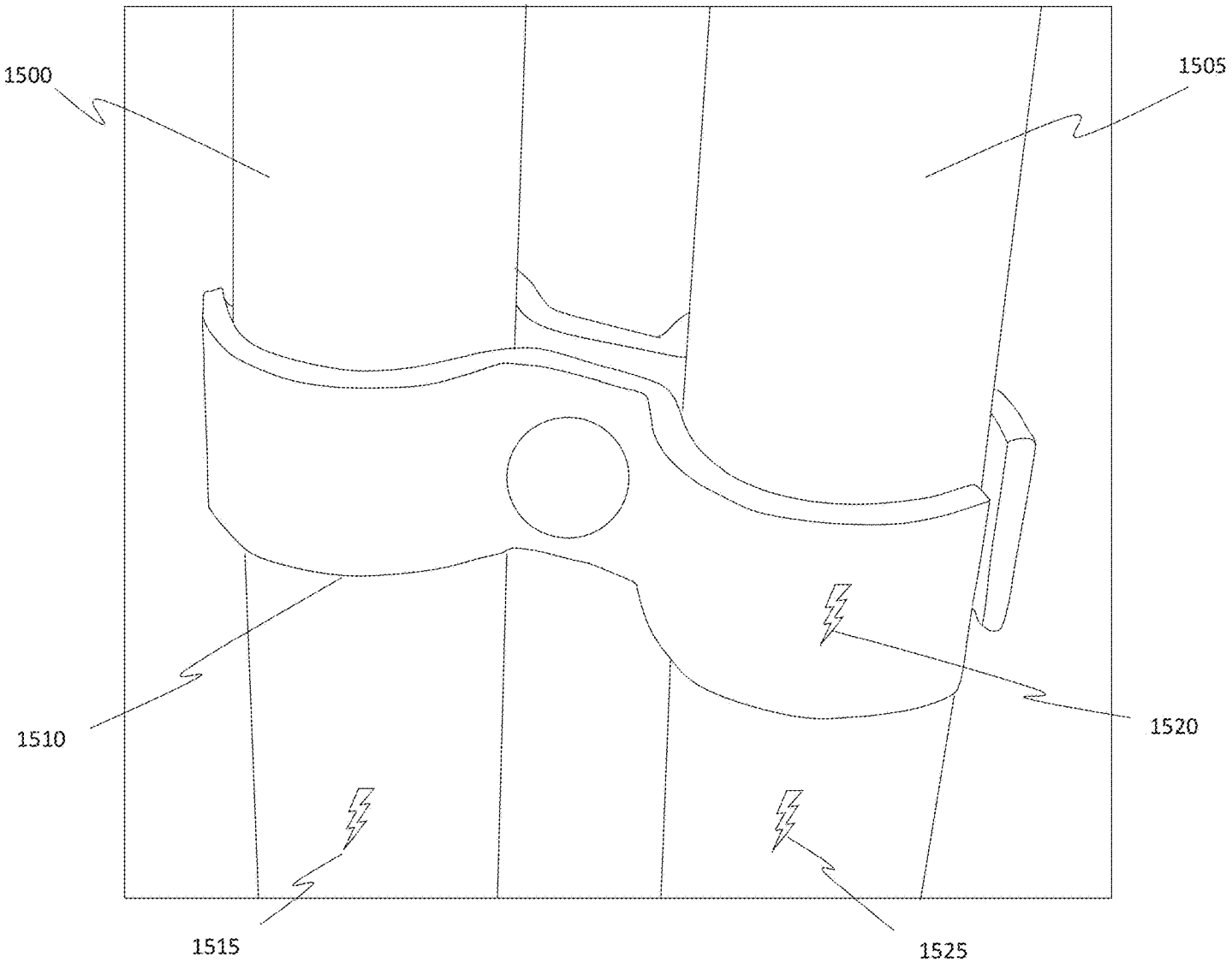
FIG. 15 illustrates an example use of the conductive bracket.

FIG. 15 shows an example use of the conductive bracket. To illustrate, FIG. 15 shows an MPSS conductive support member 1500, which is representative of any of the members 305A or 305B from FIG. 3. FIG. 15 also shows a conductive bracket 1510, which is representative of the conductive brackets shown in FIG. 14 or any of the other disclosed conductive brackets. The member 1500 is electrified 1515, as mentioned previously. Inasmuch as the conductive bracket 1510 is conductive, charge from the member 1500 can pass through the conductive bracket 1510, resulting in the conductive bracket 1510 being electrified 1520. That charge can pass to the member 1505, resulting in the member 1505 also being electrified 1525.

Non-Conductive Bracket

Figure 16:
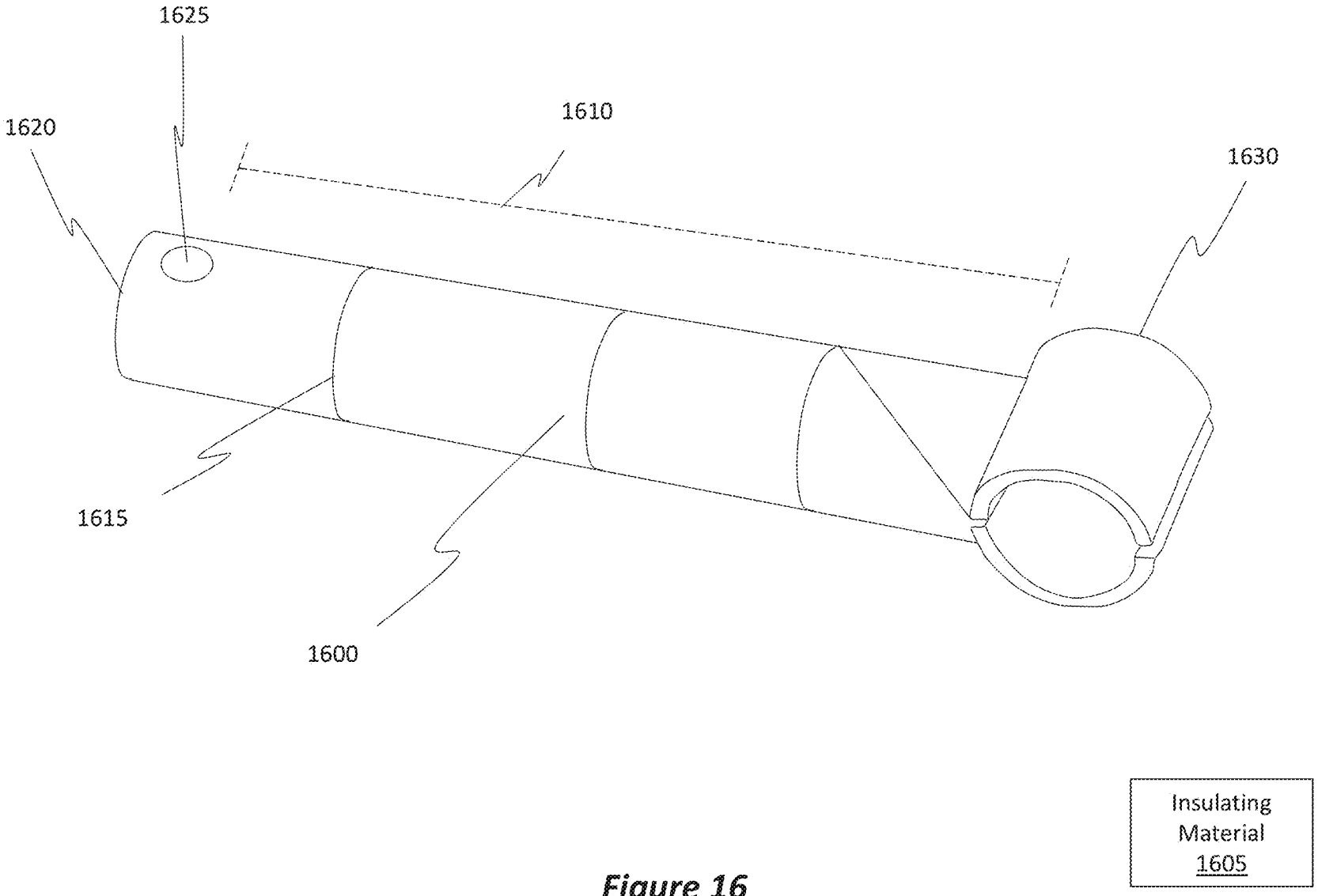
FIG. 16 illustrates an example of a non-conductive bracket.

FIG. 16 illustrates a non-conductive bracket 1600, which is representative of any of the non-conductive brackets mentioned herein. The non-conductive bracket 1600 is made of or includes insulating material 1605 to prevent a charge from passing through the non-conductive bracket 1600. The non-conductive bracket 1600 couples an MPSS to a temporary fence panel. Because of the insulating properties of the non-conductive bracket 1600, the charge from the MPSS is prevented from flowing to the temporary fence panel. As a result, the temporary fence panel is not electrified.

The length 1610 of the non-conductive bracket 1600 is at least 6 inches, resulting in the MPSS, or modular, electrically chargeable protective barrier, being spaced apart from the temporary fence panel by at least 6 inches. In some implementations, the length 1610 is between about 4 inches and about 18 inches. For instance, the length 1610 can be 4, 5, 6, 7, 8, 9, 10, 11, 12, 13, 14, 15, 16, 17, 18, or perhaps more than 18 inches.

The material of the non-conductive bracket 1600 can be any type of insulating material 1605. In some cases, the material is a plastic material, hard rubber material, ceramic material, or even wooden material. Other types of non-conductive materials can be used as well.

In one example implementation, as shown in FIG. 16, the non-conductive bracket 1600 includes a cylindrical component 1615 or main body spanning a majority of the length of the bracket. In some cases, a majority of the cylindrical component 1615 is hollow while in other cases the majority of the cylindrical component 1615 is solid.

The bracket further includes a first end 1620 that includes a hollow section. A protruding portion from the support member of the MPSS is inserted into this hollow section. The protruding portion of the support member further includes a retractable push pin that can be inserted into the hole 1625 disposed at a location proximate to the first end 1620. By inserting the retractable push pin into the hole 1625, the bracket 1600 can be securely coupled to the support member of the MPSS. An example illustration will be provided shortly.

The bracket further includes a second end 1630 that includes a hollow cylindrical portion. The second end 1630 couples to a support member of a temporary fence panel.

Figure 17:
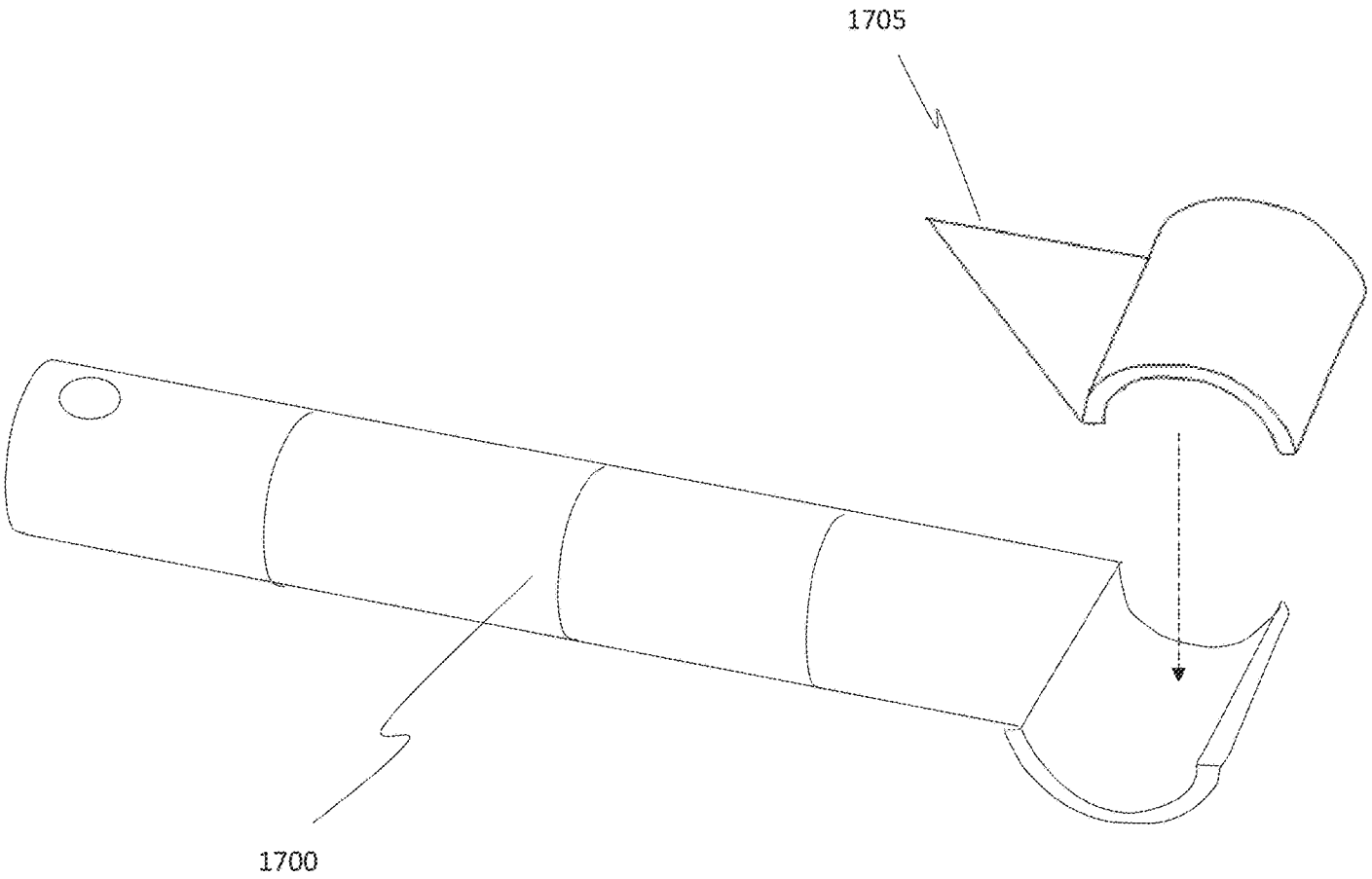
FIG. 17 illustrates another example of the non-conductive bracket.
Figure 18:
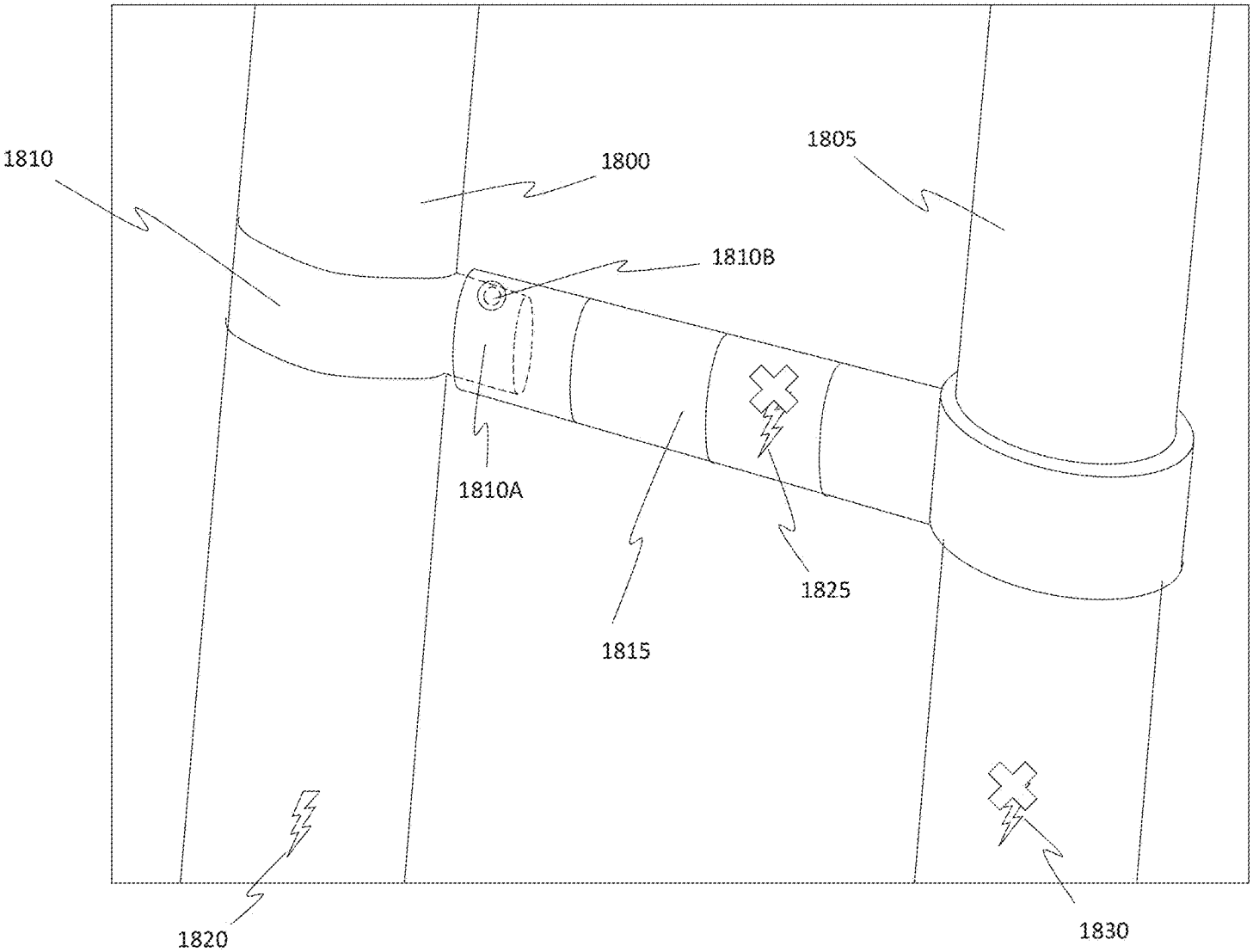
FIG. 18 illustrates an example usage of the non-conductive bracket.

For example, FIG. 17 shows a non-conductive bracket 1700 that is representative of the bracket 1600 of FIG. 16. In this scenario, the hollow cylindrical portion of the second end is shown as being in a removed state, as shown by the detachable portion 1705 being separated from the rest of the bracket 1700. The detachable portion 1705 can couple to the other portion of the bracket via a bolt and nut, a snap latch mechanism/press fit mechanism, or via any coupling technique. FIG. 18 shows an example usage of the non-conductive bracket.

FIG. 18 shows an MPSS conductive support member 1800 and a temporary fence panel support member 1805. The MPSS conductive support member 1800 includes a connection member 1810 that includes a protruding portion 1810A and a retractable push pin 1810B, which may be spring loaded. FIG. 18 also shows a non-conductive bracket 1815. The protruding portion 1810A is shown as being inserted into the hollow cavity of the non-conductive bracket 1815, and the retractable push pin 1810B is inserted into the hole on the bracket 1815 (e.g., hole 1625 of FIG. 16), thereby securing the non-conductive bracket 1815 to the MPSS conductive support member 1800.

The MPSS conductive support member 1800 is electrified 1820. The non-conductive bracket 1815 acts as an insulator and thus is not electrified 1825. Inasmuch as a charge is prevented from flowing through the non-conductive bracket 1815, the temporary fence panel support member 1805 is thus also not electrified 1830.

Figure 19:
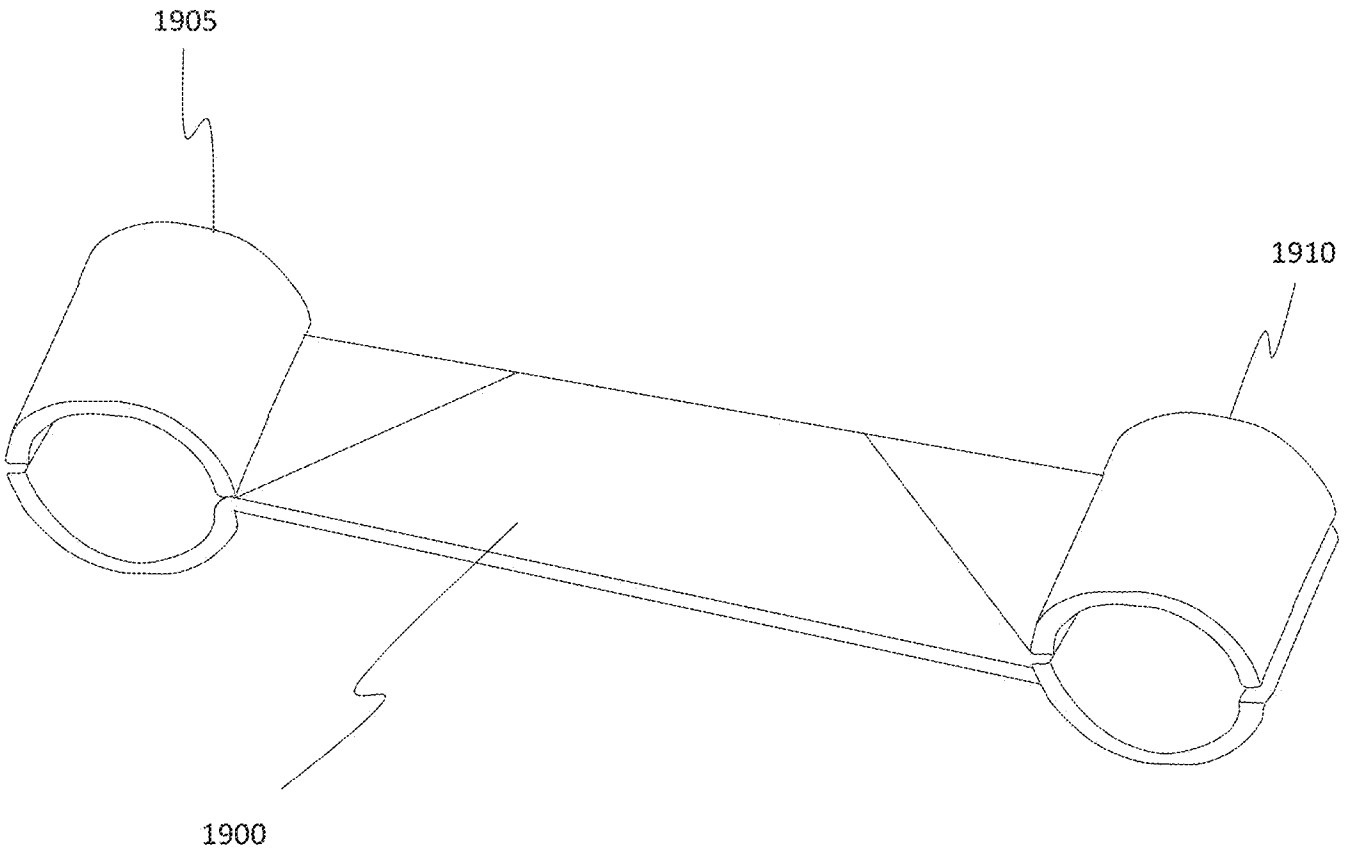
FIG. 19 illustrates a variation of the non-conductive bracket.

FIG. 19 shows a variation of a non-conductive bracket 1900 that includes a first end 1905 and a second end 1910. In this example scenario, both of the ends 1905/1910 are structured in the same manner and include hollow cylindrical portions. Also, the middle section of the bracket 1900 is shown as being planar and not cylindrical.

Figure 20:
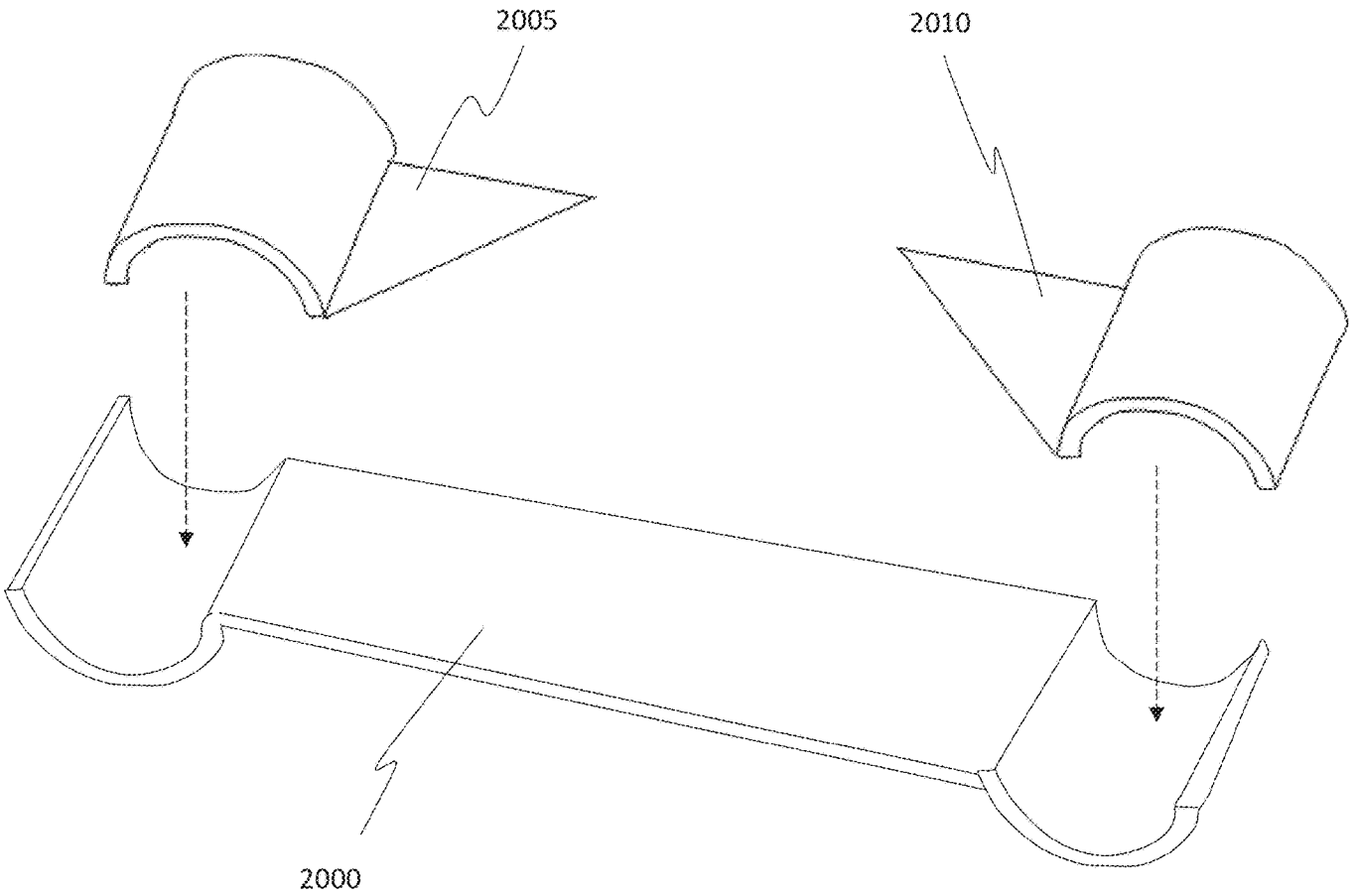
FIG. 20 illustrates a view of the non-conductive bracket.

FIG. 20 shows the non-conductive bracket 2000 as well as a first detachable portion 2005 and a second detachable portion 2010. As before, these detachable portions can attach to the remaining portion of the bracket via any coupling mechanism, such as a snap fit.

Figure 21:
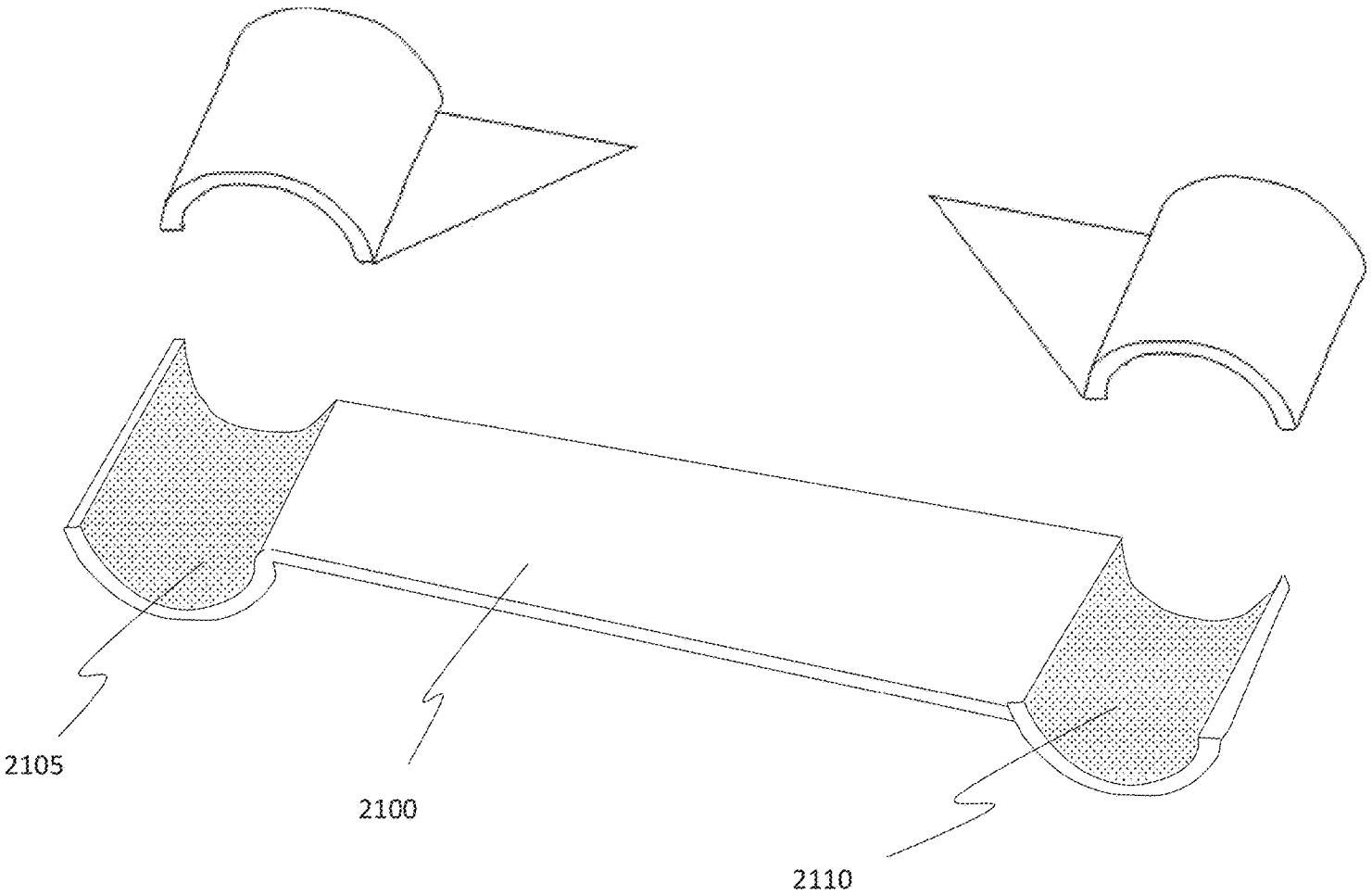
FIG. 21 illustrates a feature of the non-conductive bracket.

FIG. 21 shows a non-conductive bracket 2100 that includes additional insulating material, such as insulating material 2105 and 2110. The insulating material is disposed in the hollow cylindrical regions of the bracket, as shown in FIG. 21. The non-conductive brackets in FIGS. 16 and 17 can also include insulating material in the hollow cylindrical regions. In some cases, the insulating materials 2105/2110 can further operate as a cushioning pad, space buffer, or split resistant material to prevent the bracket from shifting position. As a space buffer, the insulating material can also ensure that the non-conductive bracket 2100 snugly fits on the support member of the temporary fence panel. More or less insulating material can be used to accommodate different sizes of the support members for the temporary fence panel.

Figure 22:
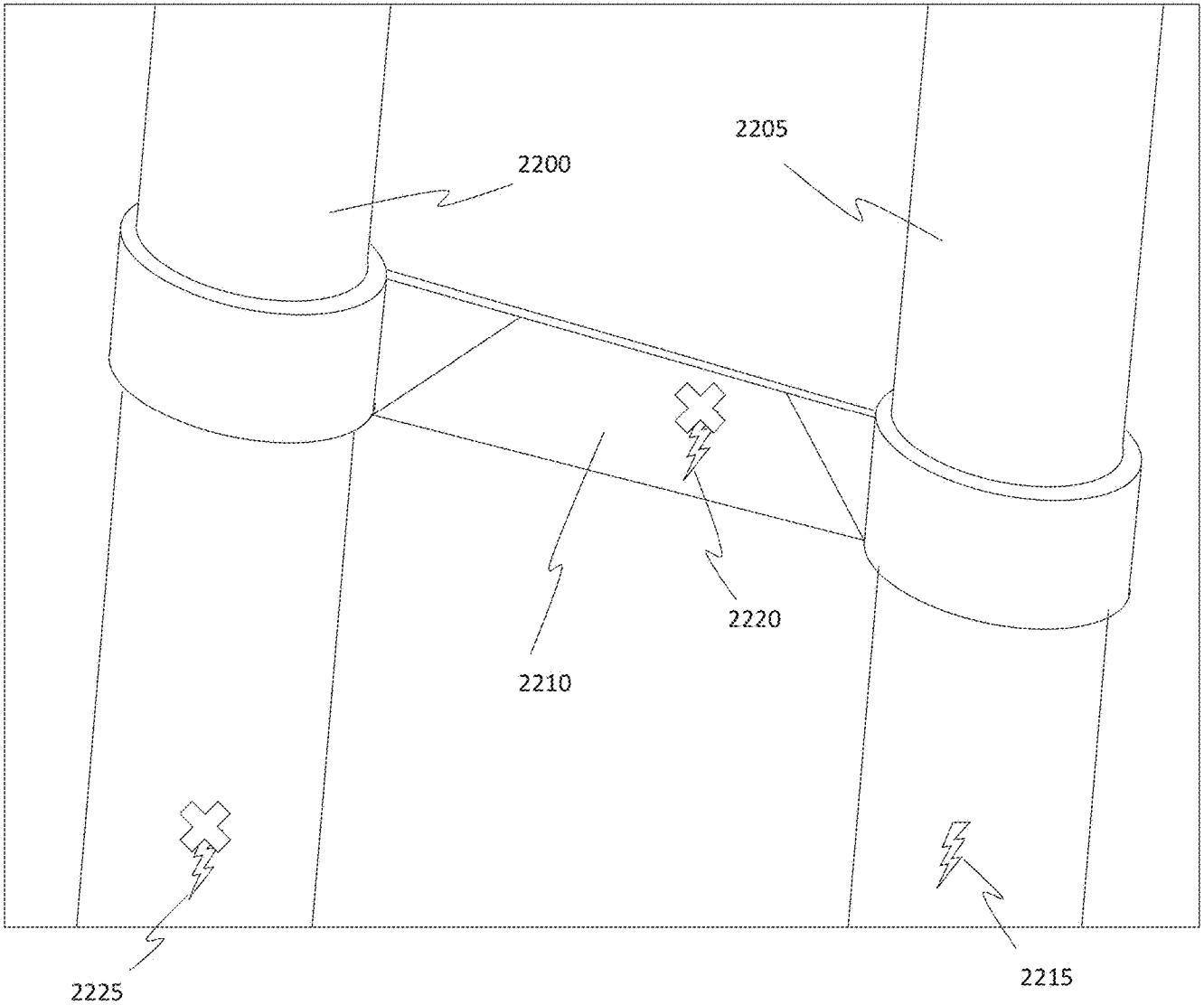
FIG. 22 illustrates an example usage of the non-conductive bracket.

FIG. 22 shows an example usage of the non-conductive bracket. In particular, FIG. 22 shows a temporary fence panel support member 2200, an MPSS conductive support member 2205, and a non-conductive bracket 2210 configured in the manner shown in FIGS. 19, 20, and 21. The MPSS conductive support member 2205 is electrified 2215; the non-conductive bracket 2210 is not electrified 2220; and the temporary fence panel support member 2200 is not electrified 2225.

Additional Base Supports

Figure 23:
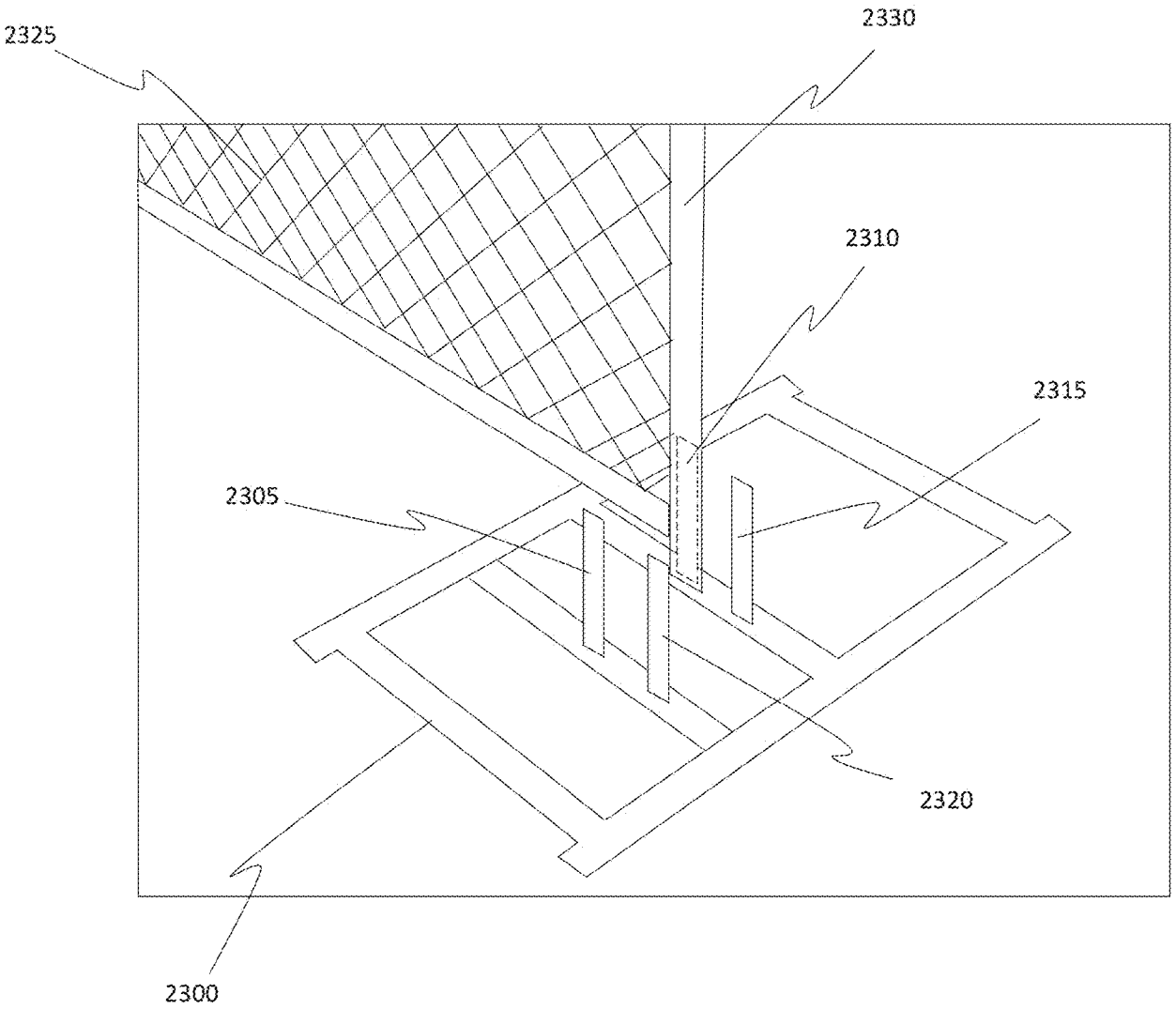
FIG. 23 illustrates an example of a base.

FIG. 23 shows an example base that can be used to accommodate and support multiple temporary fence panels and multiple MPSSs. In particular, FIG. 23 shows a base 2300 that includes multiple vertical protruding members, such as protruding members 2305, 2310, 2315, and 2320. The protruding members 2310 and 2315 are structured to accommodate a first support member from a first temporary fence panel and a second support member from a second temporary fence panel, respectively. For instance, FIG. 23 shows a temporary fence panel 2325 that includes a support member 2330. The support member 2330 includes a hollow cavity into which the protruding member 2310 can be inserted. A support member from a second temporary fence panel can accommodate the protruding member 2315.

Additionally, the protruding member 2305 can accommodate a first base member (e.g., base member 320 from FIG. 3) from a first MPSS. For instance, the first base member may include a hollow cavity into which the protruding member 2305 can be disposed so as to provide support for the first MPSS. The protruding member 2320 can accommodate a second base member from a second MPSS. For instance, the second base member may include a hollow cavity into which the protruding member 2320 can be disposed so as to provide support for the second MPSS.

Controller

Figure 24:
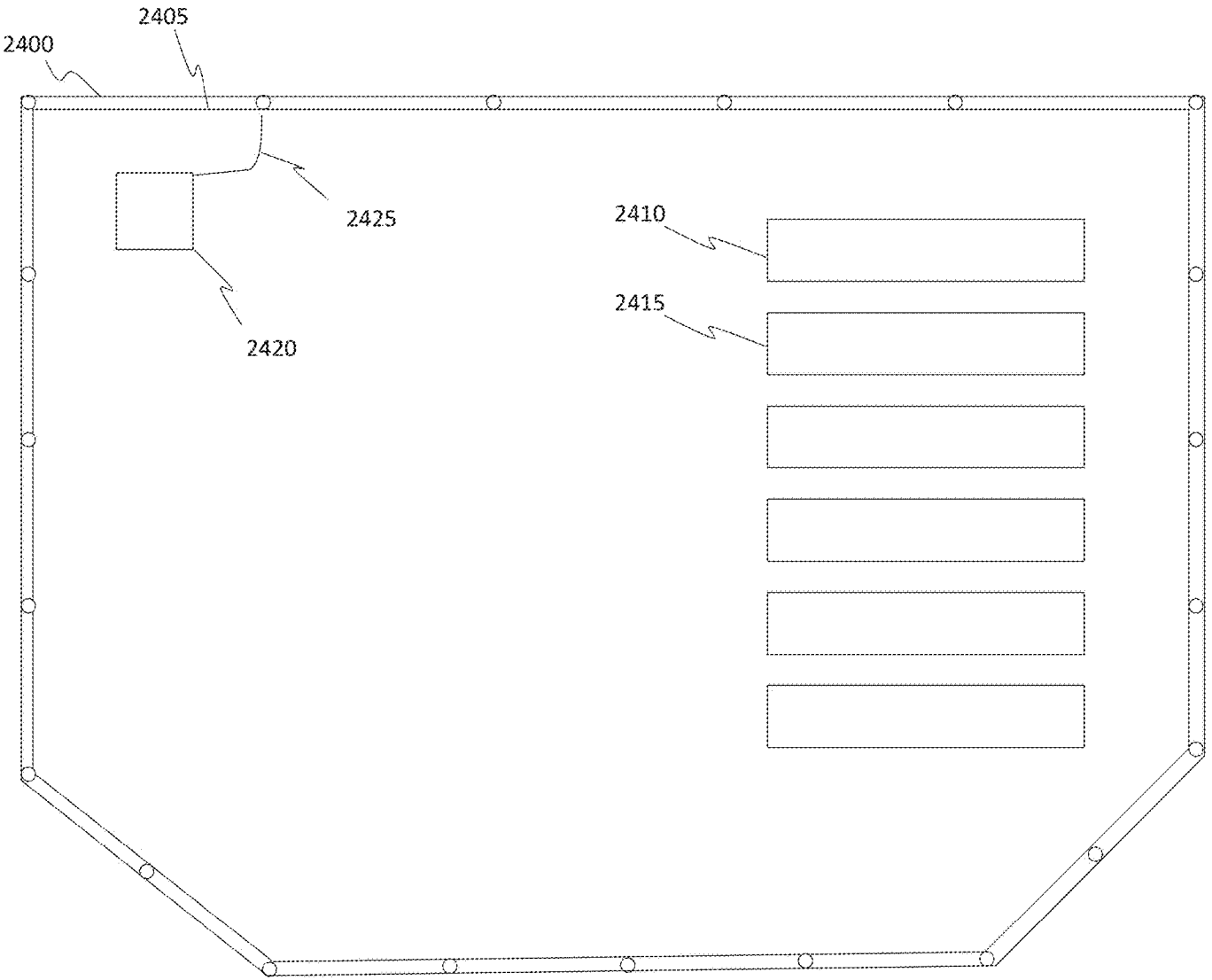
FIG. 24 illustrates an example usage of the MPSS.

FIG. 24 shows an example scenario involving any number of temporary fence panels, one of which is labeled as temporary fence panel 2400, and any number of MPSS, such as MPSS 2405. The combination of the temporary fence panels and the MPSSs form a barricade around a number of assets, such as assets 2410 and 2415 to protect those assets. Of course, an MPSS can also be used to provide any type of area, even one without specific assets.

Figure 25:
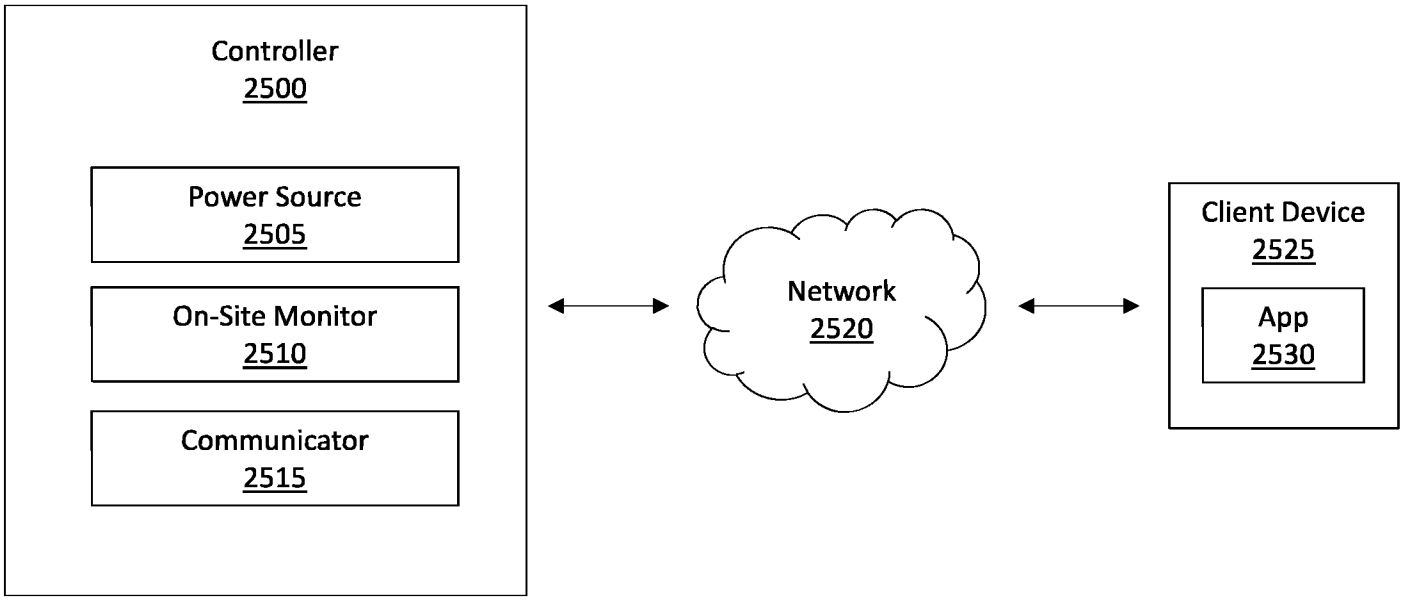
FIG. 25 illustrates an example of a controller for the MPSS.

The MPSSs are associated with a controller 2420 that includes an electrical connection 2425 between the controller 2420 and the MPSSs. The controller 2420 can be used to energize or electrify the MPSS. Additionally, the controller 2420 can be controlled via the use of a client-side application. FIG. 25 provides further details.

FIG. 25 shows an example controller 2500 that is representative of the controller 2420 from FIG. 24. Controller 2500 includes a power source 2505, such as a solar power source, a connection to a power grid, or any other type of power source. The power source 2505 is used to energize the MPSSs shown in FIG. 24. The power source 2505 is coupled to the MPSSs via the electrical connection 2425 of FIG. 24.

Controller 2500 further includes an on-site monitor 2510. The on-site monitor 2510 can include any type or number of sensors. Such sensors include, but are not limited to, video sensors, microphones, speakers, climate sensors, device operational sensors, voltage and current sensors, spotlights, night vision sensors, thermal sensors, motion detection sensors, and so on. The on-site monitor 2510 can be triggered in response to motion or a detected presence.

In some implementations, the MPSSs are kept in a default powered off state such that, as a default, the MPSS are not electrified. For instance, if no motion is detected near the MPSSs, the MPSSs may not be energized. After motion is detected, such as via use of the motion detector, then the MPSSs may be energized. The embodiments may turn off the energy after a determined period of time after no motion is detected.

In other implementations, the MPSS are kept in a default powered on state such that, as a default, the MPSS are electrified. Thus, even if no motion is detected, the MPSSs are still energized.

The controller 2500 can include a communicator 2515 to enable the controller 2500 to communicate over a network 2520. In some cases, the communicator 2515 has a wired connection to the network 2520. In some cases, the communicator 2515 has a wireless connection to the network 2520, such as via use of a Wi-Fi broadband connection or a telecommunications (e.g., 4G, 5G, etc.) connection. Using the communicator 2515, the controller 2500 can communicate with a client device 2525 hosting an application (app) 2530. The app 2530 can be used to control the energization state of the MPSSs as well as display the information obtained from the on-site monitor 2510.

Accordingly, the disclosed embodiments relate to a mobile security system. This system includes a frame comprising a first side vertical conductive support member, a second side vertical conductive support member, a middle vertical conductive support member, an upper horizontal conductive support member, a lower horizontal conductive support member, a middle horizontal conductive support member. The frame is electrically chargeable.

The system further includes multiple exposed conductive wires spanning a distance between the first side vertical conductive support member and the second side vertical conductive support member. The exposed conductive wires are also electrically chargeable.

The system includes a conductive bracket. The conductive bracket is structured to facilitate coupling the frame of the mobile security system to a different frame of a different mobile security system. The conductive bracket is also electrically chargeable.

The system further includes a non-conductive bracket. The non-conductive bracket is structured to facilitate coupling the frame to a temporary fence panel. The non-conductive bracket is insulated from being electrically chargeable.

In some embodiments, the frame is formed of galvanized steel, which is conductive. Optionally, the width of the frame is between about 8 feet and about 14 feet. Similarly, the height of the frame is between about 8 feet and about 14 feet. The height of the frame is typically higher than the height of the temporary fence panel.

In some embodiments, at least some distances between the conductive wires are different. In some embodiments, the distances between the conductive wires are the same.

In some embodiments, the first side vertical conductive support member includes a first hole, and the second side vertical conductive support member includes a second hole. One of the conductive wires loops through both the first hole and the second hole.

In some embodiments, the conductive bracket is one of multiple conductive brackets. Optionally, these conductive brackets can include at least four conductive brackets. Similarly, in some embodiments, the non-conductive bracket is one of multiple non-conductive brackets. Optionally, the non-conductive brackets can include at least four non-conductive brackets.

In some embodiments, the frame further includes a first base member and a second base member (e.g., base members 315 and 320 from FIG. 3). In this scenario, both the first base member and the second base member are insulated from being electrically charged.

Some embodiments are directed to a modular, electrically chargeable protective barrier (aka an MPSS) that is structured to be coupled to a temporary fence panel. The modular, electrically chargeable protective barrier includes a frame comprising a first side vertical conductive support member, a second side vertical conductive support member, a middle vertical conductive support member, an upper horizontal conductive support member, and a lower horizontal conductive support member. The frame is electrically chargeable.

The barrier includes multiple exposed conductive wires spanning a distance between the first side vertical conductive support member and the second side vertical conductive support member. The exposed conductive wires are electrically chargeable, and a charge passes from the exposed conductive wires to the frame.

The barrier includes a conductive bracket disposed on either one of the first side vertical conductive support member or the second side vertical conductive support member. The conductive bracket is structured to facilitate coupling the frame of the modular, electrically chargeable protective barrier to a different frame of a different modular, electrically chargeable protective barrier. The conductive bracket is electrically chargeable, and the charge passes from the frame to the conductive bracket.

The barrier includes a non-conductive bracket disposed on either one of the first side vertical conductive support member or the second side vertical conductive support member. The non-conductive bracket is structured to facilitate coupling the frame to the temporary fence panel, and the non-conductive bracket is insulated such that the charge is prevented from passing through the non-conductive bracket.

In some embodiments, the frame includes a base member that is adjustable in height. In some embodiments, at least one of the exposed conductive wires is coupled to the first side vertical conductive support member via a spring that hooks onto the first side vertical conductive support member.

In some embodiments, the length of the non-conductive bracket is at least 6 inches. As a result, the modular, electrically chargeable protective barrier is spaced apart from the temporary fence panel by at least 6 inches.

In some embodiments, a length of the conductive bracket is between about 2 inches and about 10 inches, resulting in the modular, electrically chargeable protective barrier being spaced apart from the different modular, electrically chargeable protective barrier by at least 2 inches. A charge passes through the conductive bracket to the different frame of the different modular, electrically chargeable protective barrier.

Some embodiments are directed to a modular, electrically chargeable protective barrier that is structured to be coupled to a temporary fence panel. The modular, electrically chargeable protective barrier includes a frame comprising a first side vertical conductive support member, a second side vertical conductive support member, a middle vertical conductive support member, an upper horizontal conductive support member, and a lower horizontal conductive support member, wherein the frame is electrically chargeable. The barrier includes multiple exposed conductive wires spanning a distance between the first side vertical conductive support member and the second side vertical conductive support member. The exposed conductive wires are electrically chargeable, and a charge passes from the exposed conductive wires to the frame.

The barrier includes a set of conductive brackets disposed on the frame. The set of conductive brackets are structured to facilitate coupling the frame to a different frame of a different modular, electrically chargeable protective barrier. The set of conductive brackets are electrically chargeable.

The barrier further includes a set of non-conductive brackets disposed on the frame. The set of non-conductive brackets are structured to facilitate coupling the frame to the temporary fence panel. The set of non-conductive brackets are insulated.

In some embodiments, the first side vertical conductive support member includes a connection member that includes a retractable push pin. A portion of the connection member is inserted into a first non-conductive bracket included in the set of non-conductive brackets, and the retractable push pin is inserted into a corresponding hole in the first non-conductive bracket. Optionally, the first non-conductive bracket includes a wrap-around portion (e.g., second end 1630 of FIG. 16) that wraps around a portion of the temporary fence panel.

In some embodiments, the weight of the modular, electrically chargeable protective barrier is less than about 75 pounds. In some cases, the weight is less than about 65 pounds. In some cases the weight is about 55 pounds.

The present invention may be embodied in other specific forms without departing from its characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A mobile perimeter security system (MPSS) comprising:

at least one frame comprising a first side vertical conductive support member, a second side vertical conductive support member, a middle vertical conductive support member, an upper horizontal conductive support member, a lower horizontal conductive support member, a middle horizontal conductive support member, wherein the at least one frame is electrically chargeable, and wherein an entirety of the at least one frame, which includes the first side vertical conductive support member, the second side vertical conductive support member, the middle vertical conductive support member, the upper horizontal conductive support member, the lower horizontal conductive support member, and the middle horizontal conductive support member, is electrically chargeable;

a plurality of exposed conductive wires spanning a distance between the first side vertical conductive support member and the second side vertical conductive support member, wherein the plurality of exposed conductive wires are electrically chargeable;

a conductive bracket, wherein the conductive bracket is structured to facilitate coupling the at least one frame of the MPSS to a second frame of a second MPSS, and wherein the conductive bracket is electrically chargeable; and a non-conductive bracket, wherein the non-conductive bracket is structured to facilitate coupling the at least one frame to a temporary fence panel, and wherein the non-conductive bracket is insulated from being electrically chargeable.

2. The MPSS of claim 1, wherein the at least one frame is formed of galvanized steel.

3. The MPSS of claim 1, wherein a width of the at least one frame is between about 8 feet and about 14 feet.

4. The MPSS of claim 1, wherein a height of the at least one frame is between about 8 feet and about 14 feet.

5. The MPSS of claim 1, wherein the conductive wires in the plurality of conductive wires span the distance in one or more of a horizontal configuration, a vertical configuration, and/or a diagonal configuration.

6. The MPSS of claim 1, wherein the first side vertical conductive support member includes a first hole, wherein the second side vertical conductive support member includes a second hole, and wherein one conductive wire included in the plurality of conductive wires loops through both the first hole and the second hole.

7. The MPSS of claim 1, wherein the conductive bracket is one of a plurality of conductive brackets, and wherein the plurality of conductive brackets includes at least four conductive brackets.

8. The MPSS of claim 1, wherein the non-conductive bracket is one of a plurality of non-conductive brackets, and wherein the plurality of non-conductive brackets includes at least four non-conductive brackets.

9. The MPSS of claim 1, wherein the at least one frame further includes a first base member and a second base member, and wherein both the first base member and the second base member are insulated from being electrically charged.

10. The MPSS of claim 1, wherein an orientation between the conductive bracket and the non-conductive bracket is approximately orthogonal.

11. The MPSS of claim 1, wherein a spacing of the exposed conductive wires in the plurality of exposed conductive wires is a progressive spacing such that a spacing for wires that are relatively closer to a bottom portion of the at least one frame is larger as compared to a spacing for wires that are relatively closer to a top portion of the at least one frame.

12. A modular, electrically chargeable protective barrier that is structured to be coupled to a temporary fence panel, said modular, electrically chargeable protective barrier comprising:

at least one frame comprising a first side vertical conductive support member, a second side vertical conductive support member, a middle vertical conductive support member, an upper horizontal conductive support member, and a lower horizontal conductive support member, wherein the at least one frame is electrically chargeable, and wherein an entirety of the at least one frame which includes the first side vertical conductive support member, the second side vertical conductive support member, the middle vertical conductive support member, the upper horizontal conductive support member, the lower horizontal conductive support member, and the middle horizontal conductive support member, is electrically chargeable;

a plurality of exposed conductive wires spanning a distance between the first side vertical conductive support member and the second side vertical conductive support member, wherein the plurality of exposed conductive wires are electrically chargeable, and wherein a charge passes from the plurality of exposed conductive wires to the at least one frame;

a conductive bracket disposed on either one of the first side vertical conductive support member or the second side vertical conductive support member, wherein the conductive bracket is structured to facilitate coupling the at least one frame of the modular, electrically chargeable protective barrier to a second frame of a second modular, electrically chargeable protective barrier, wherein the conductive bracket is electrically chargeable, and wherein the charge passes from the at least one frame to the conductive bracket; and a non-conductive bracket disposed on either one of the first side vertical conductive support member or the second side vertical conductive support member, wherein the non-conductive bracket is structured to facilitate coupling the at least one frame to the temporary fence panel, and wherein the non-conductive bracket is insulated such that the charge is prevented from passing through the non-conductive bracket.

13. The modular, electrically chargeable protective barrier of claim 12, wherein the at least one frame includes a base member that is adjustable in height.

14. The modular, electrically chargeable protective barrier of claim 12, wherein at least one exposed conductive wire in the plurality of exposed conductive wires is coupled to the first side vertical conductive support member via a spring that hooks onto the first side vertical conductive support member.

15. The modular, electrically chargeable protective barrier of claim 12, wherein a length of the conductive bracket is between about 2 inches and about 10 inches, resulting in the modular, electrically chargeable protective barrier being spaced apart from the different modular, electrically chargeable protective barrier by at least 2 inches.

16. The modular, electrically chargeable protective barrier of claim 12, wherein the charge passes through the conductive bracket to the t-second frame of the second modular, electrically chargeable protective barrier.

17. A modular, electrically chargeable protective barrier that is structured to be coupled to a temporary fence panel, said modular, electrically chargeable protective barrier comprising:

at least one frame comprising a first side vertical conductive support member, a second side vertical conductive support member, a middle vertical conductive support member, an upper horizontal conductive support member, and a lower horizontal conductive support member, wherein the at least one frame is electrically chargeable, and wherein an entirety of the at least one frame which includes the first side vertical conductive support member, the second side vertical conductive support member, the middle vertical conductive support member, the upper horizontal conductive support member, the lower horizontal conductive support member, and the middle horizontal conductive support member, is electrically chargeable;

a plurality of exposed conductive wires spanning a distance between the first side vertical conductive support member and the second side vertical conductive support member, wherein the plurality of exposed conductive wires are electrically chargeable, and wherein a charge passes from the plurality of exposed conductive wires to the at least one frame;

a set of conductive brackets disposed on the at least one frame, wherein the set of conductive brackets are structured to facilitate coupling the at least one frame to a second frame of a second modular, electrically chargeable protective barrier, wherein the set of conductive brackets are electrically chargeable; and a set of non-conductive brackets disposed on the at least one frame, wherein the set of non-conductive brackets are structured to facilitate coupling the at least one frame to the temporary fence panel, and wherein the set of non-conductive brackets are insulated.

18. The modular, electrically chargeable protective barrier of claim 17, wherein the first side vertical conductive support member includes a connection member that includes a retractable push pin, and wherein a portion of the connection member is inserted into a first non-conductive bracket included in the set of non-conductive brackets, and wherein the retractable push pin is inserted into a corresponding hole in the first non-conductive bracket.

19. The modular, electrically chargeable protective barrier of claim 18, wherein the first non-conductive bracket includes a wrap-around portion that wraps around a portion of the temporary fence panel.

20. The modular, electrically chargeable protective barrier of claim 17, wherein a weight of the modular, electrically chargeable protective barrier is less than about 75 Pounds.

* * * * *